US009591915B2

(12) United States Patent
Willows et al.

(10) Patent No.: US 9,591,915 B2
(45) Date of Patent: Mar. 14, 2017

(54) BOTTLE SLEEVE AND MATING BOTTLE

(71) Applicant: Amphipod, Inc., Seattle, WA (US)

(72) Inventors: Keith S. Willows, Seattle, WA (US); June A. Angus, Seattle, WA (US); Antonio Del Rosario, Bellevue, WA (US)

(73) Assignee: Amphipod, Inc., Seattle, WA (US)

( * ) Notice: Subject to any disclaimer, the term of this patent is extended or adjusted under 35 U.S.C. 154(b) by 113 days.

(21) Appl. No.: 14/596,839

(22) Filed: Jan. 14, 2015

(65) Prior Publication Data

US 2015/0196112 A1 Jul. 16, 2015

Related U.S. Application Data

(60) Provisional application No. 61/964,799, filed on Jan. 14, 2014.

(51) Int. Cl.

| | |
|---|---|
| ***A45F 3/00*** | (2006.01) |
| ***A45F 5/02*** | (2006.01) |
| ***A47G 23/02*** | (2006.01) |
| ***A45F 3/16*** | (2006.01) |

(52) U.S. Cl.

CPC ..... *A45F 5/021* (2013.01); *A45F 3/16* (2013.01); *A47G 23/0241* (2013.01); *A45F 2200/0583* (2013.01)

(58) Field of Classification Search

CPC ..... A45F 3/16; A45F 2200/0583; A45F 5/00; A45F 5/021; A45F 3/005; A45F 2003/166; A61J 9/08; A47G 23/0241

USPC ..... 224/148.1, 148.4, 148.5, 148.6, 148.7, 224/242, 245, 246

See application file for complete search history.

(56) References Cited

U.S. PATENT DOCUMENTS

| | | | | |
|---|---|---|---|---|
| D219,954 | S | 2/1971 | Koenigsberg | |
| 4,176,772 | A | 12/1979 | Danon | |
| 4,197,890 | A | 4/1980 | Simko | |
| D257,409 | S | 10/1980 | Kishbaugh et al. | |
| D300,904 | S | 5/1989 | Pardo et al. | |
| 4,974,762 | A | 12/1990 | Boretsky et al. | |
| 4,993,565 | A | 2/1991 | Ota et al. | |
| D318,798 | S | 8/1991 | Biesecker | |
| D320,455 | S | 10/1991 | Malcolm | |
| 5,094,376 | A * | 3/1992 | Baruch | F41A 17/54 224/193 |
| 5,150,824 | A | 9/1992 | Alvarez et al. | |
| 5,209,385 | A | 5/1993 | Ledesma | |

(Continued)

FOREIGN PATENT DOCUMENTS

JP 07101517 4/1995

OTHER PUBLICATIONS

Ultimate Direction, 2002 High Performance Hydration.
Amphipod 2004 Catalog.

*Primary Examiner* — Adam Waggenspack
(74) *Attorney, Agent, or Firm* — Lowe Graham Jones, PLLC

(57) ABSTRACT

A preferred sleeve for a bottle includes a floor and upwardly extending sidewalls, terminating in an upper rim which forms a shoulder extending partially over the interior space. A detent or detent form is provided along an upper rim, diametrically opposite the shoulder. One or more openings may be provided in the lower portion of the sleeve to facilitate removal of the bottle by tilting it away from the shoulder.

16 Claims, 22 Drawing Sheets

(56) References Cited

U.S. PATENT DOCUMENTS

| | | | | |
|---|---|---|---|---|
| 5,427,290 | A | 6/1995 | Thatcher | |
| 5,570,824 | A | 11/1996 | Lyon et al. | |
| D392,390 | S | 3/1998 | Chan et al. | |
| 5,722,574 | A | 3/1998 | Pratt | |
| 5,727,720 | A | 3/1998 | Thatcher | |
| D393,211 | S | 4/1998 | Mengeu | |
| 5,758,790 | A | 6/1998 | Ewing, Jr. | |
| 5,772,090 | A | 6/1998 | Rodriguez | |
| 5,873,551 | A | 2/1999 | Jones | |
| 5,890,809 | A | 4/1999 | Nelson | |
| D410,770 | S | 6/1999 | Bergara | |
| 6,109,496 | A | 8/2000 | Andrew et al. | |
| 6,179,185 | B1 | 1/2001 | Dancyger | |
| 6,182,872 | B1 * | 2/2001 | Six | A45F 3/00 224/148.3 |
| 6,237,820 | B1 | 5/2001 | Saxton | |
| D444,295 | S * | 7/2001 | Malik | D3/224 |
| 6,321,958 | B1 | 11/2001 | Erdmann | |
| 6,401,993 | B1 | 6/2002 | Andrino | |
| 6,405,912 | B2 | 6/2002 | Giannou | |
| 6,446,852 | B1 | 9/2002 | Sorensen et al. | |
| 6,454,146 | B2 | 9/2002 | Alis | |
| 6,508,391 | B2 | 1/2003 | Gilbert | |
| 6,626,342 | B1 | 9/2003 | Gleason | |
| 6,659,321 | B2 | 12/2003 | Hartranft et al. | |
| 6,971,562 | B2 | 12/2005 | Willows et al. | |
| 7,520,412 | B2 | 4/2009 | Willows et al. | |
| 8,002,157 | B2 | 8/2011 | Willows et al. | |
| 8,985,409 | B2 | 3/2015 | Willows et al. | |
| 2004/0155075 | A1 * | 8/2004 | Dorian | A45F 3/16 224/148.4 |
| 2007/0175787 | A1 | 8/2007 | Lown et al. | |
| 2010/0102096 | A1 * | 4/2010 | Willows | A45F 5/00 224/148.1 |

* cited by examiner

BOTTLE SLEEVE AND MATING BOTTLE

PRIORITY CLAIM

This application claims the benefit of prior U.S. provisional application Ser. No. 61/964,799, filed Jan. 14, 2014, the contents of which are incorporated by reference.

FIELD OF THE INVENTION

This invention relates to bottles and mating bottle holders, including processes for making such bottles and holders.

SUMMARY OF THE INVENTION

The present invention relates generally to sleeves for holding bottles, particularly for attachment to a belt or similar structure to be worn by a user.

The preferred sleeve can be manufactured by die-cutting or through other processes, preferably from flat sheet material. In some versions, the substrate material may have surfaces ornamented with surface texture, printing or other embellishments.

The sleeves are preferably configured for attachment to a hydration belt assembly having a pair of sleeves. In some versions, a left-handed sleeve and a right-handed sleeve are each mounted to a waist belt with an optional pouch and optional buckle (or other form of closure). The waist belt 13 is preferably woven elastic webbing.

In some examples, the sleeves can be canted to a desired angle and fastened to the belt in a canted/angled position. Canting the sleeves can increase the security of the bottle being held in the sleeve. The degree of cant/tilt may vary with user preference, but ideally it would be slightly canted to the side in a range between 5 to 20 degrees from the vertical.

In some versions, the sleeve is formed by an outer sleeve sidewall forming an interior space. The outer sleeve sidewall further includes a central bottom portion having a floor and opposing generally vertical portions in order to receive and retain a bottle by the floor and opposing vertical portions. Opposite sides adjacent the central bottom portion are open, allowing lower left and right corners of a bottle to extend through the lower open portions. Thus, a lower left corner of the sidewall forms a first opening, while a lower right corner forms an opposite second opening. The first and second openings may be the same size, or one may be larger than the other. In the illustrated example, the second opening is larger than the first opening, such that the upper end of the second opening extends higher above the bottom of the central portion than the upper end of the first opening does.

The upwardly extending sidewalls of the sleeve terminate in an upper rim, thereby forming an upper opening for access into the interior space defined by the sleeve. Most preferably, the upper rim is inclined, with one side considerably higher than the diametrically opposite side of the rim. In the illustrated example, the upper rim terminates at a first lower location above the first lower opening, and at a second higher location above the second lower opening. In addition, the upper second location 96 along the rim extends inward, partially over the interior space defined by the rim, in order to impede a bottle from being removed from the sleeve in a directly vertical direction.

In some versions, such as when configured from sheet stock material, the preferred sleeve is configured initially with a central stem which forms the central portion of the sidewalls and the floor. A right branch forms the first portion of the rim as well as defining the upper boundary of the first lower opening. An upper left branch defines the second portion of the rim, while a lower left branch defines the upper boundary of the second lower opening. The arcuate gap between the upper and lower left branches facilitates formation of the sleeve while enabling the second portion of the rim to extend inward, over the interior portion of the sleeve.

The preferred sleeve is preferably sized to snugly receive the bottle, yet loose enough such that the bottle can be simply removed from the sleeve. Preferably, a bottle detent flap would be folded over along bend/score lines and then fastened and folded over in place by stitching. Once folded inward, the detent flap will be folded inward so that it is adjacent a sleeve sidewall portion which forms an outer upper portion of the sleeve when it is fully assembled. The stitching could be replaced by other fastening means such as heat-bonding, gluing, double-sided tape, snaps, hook and loop fasteners, feeding it through a hole or slot in the sleeve, or other means whereby the flap provides its desired function of helping to hold the bottle securely in the preferred sleeve. The length and size of the flap can be adjusted to adjust the desired pressure on the bottle which is a method of adjusting the desired level of security for holding the bottle.

BRIEF DESCRIPTION OF THE DRAWINGS

Preferred and alternative examples of the present invention are described in detail below with reference to the following drawings:

In FIGS. 10 through 15, only the portion of the section is shown which is adjacent stitch 32 shown in FIG. 6; the rest of the sections are omitted for simplicity.

FIG. 11 is a partial section view through section B-B of FIG. 6 (adjacent stitch 32) wherein the second embodiment of preferred geometry for a preferred sleeve is shown in this section.

FIG. 12 is a partial section view through section B-B of FIG. 6 wherein the third embodiment of preferred geometry for a preferred sleeve is shown.

FIG. 13 is a partial section view through section B-B of FIG. 6 wherein a fourth embodiment of preferred geometry for a preferred sleeve is shown.

FIG. 14 is a partial section view through section B-B of FIG. 6 wherein a fifth embodiment of preferred geometry for a preferred sleeve is shown.

FIG. 15 is a partial section view through section C-C of FIG. 19 wherein another embodiment of preferred geometry for a preferred sleeve is shown. The same portion is cut away as the above sections for simplicity.

DETAILED DESCRIPTION OF THE PREFERRED EMBODIMENT

Figure 1:
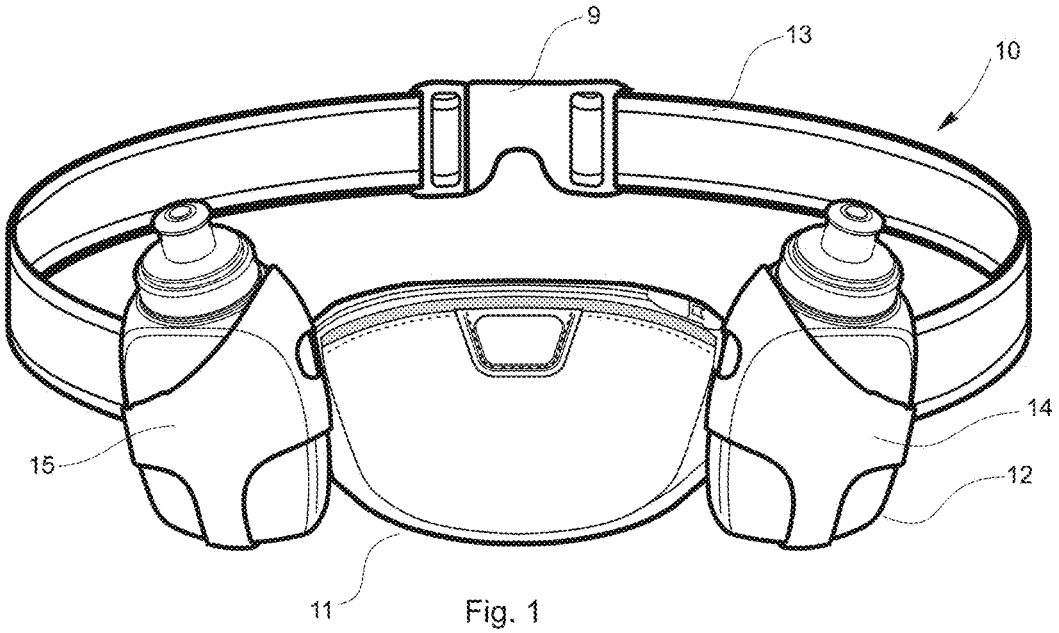
FIG. 1 is a perspective view of a preferred embodiment of the invention. The embodiment shows a left (labeled 15) and a right-handed version 14 of the preferred sleeve mounted to a waist belt 13 with optional pouch 11. It should be noted right-handed and left-handed are only used for describing the convention when looking at the version as drawn in FIG. 1. A user may wear the belt with the pouch 10 toward the front instead of the back, in which case the left and right orientation are reversed from the perspective of the user.

References will now be made to the drawings in which the various elements of the present invention will be given numeral designations and in which the invention will be discussed so as to enable one skilled in the art to make and use the invention. It is to be understood that the following description is only exemplary of the principles of the invention, and should not be viewed as narrowing the scope of the invention.

The disclosed preferred sleeve (for most applications) is manufactured from thin sheet material, in which the sleeve is preferably die-cut or otherwise produced from the sheet material. Somewhat flexible polypropylene, polyethylene, Vinyl, Nylon and similar sheet material are desirable sheet materials that can be used to manufacture the preferred bottle sleeve. Preferably the preferred sheet material is of the flexibility that it can be formed and preferably sewn and bent without cracking or breaking easily.

Further, the plastic sheet material is preferably laminated with other sheet material such as a fabric so that the lamination of two or more materials creates desirable durability, structure, high strength-to-weight ratio, good visual appeal and other desirable characteristics. Examples for appropriate fabric sheet fabrics/materials include: lycra spandex, nylon, woven or non-woven polyester, cotton sheet fabric, vinyl, etc. Different fabrics can be used depending on the desired aesthetic, engineering/mechanical, and other desired properties.

The preferred total sheet thickness for the sheet material (after various sheet materials are laminated (with glue, heat/ultrasonically bonded, etc. or the like) together to form the preferred composite sheet) is from 30 to 70 thousands of an inch (0.030 to 0.070 of an inch) with the plastic sheet material (without the preferred fabric lamination) being between 0.025 and 0.065 of an inch thick. A preferred optimal thickness for the plastic alone is about 0.040 to 0.055 of an inch whereby a desirable strength-to-weight ratio and stiffness can be achieved using an appropriately stiff plastic similar to the kind commonly used in notebook sheet lifters. The fabric sheet material laminated to the plastic sheet is preferably in the range of 0.003 to 0.015 of an inch thick for most applications, although for some applications it could be more or less thick. It should be noted that preferred resulting sheet material (after sleeve is assembled into a product) for the sleeve is preferably flexible but not appreciably stretchy. The preferred structure and relative stiffness of the disclosed sleeve is desirable as it allows the sleeve to be very light in weight while maintaining its integrity, while holding a relatively heavy item like a water bottle and allowing this weight to be efficiently held and transferred to a person's body without bounce and annoyance.

The preferred sleeve can be manufactured by die-cutting or through other processes. The substrate material may have surfaces ornamented with surface texture, printing or other embellishments, although a lamination of two or more sheet materials is preferred. Also the sleeve can be manufactured from sheet material that is printed, stickered/decaled, silk-screened, coated, painted, or otherwise clad with a thin layer of material that preferably adds visual appeal but also could add strength, durability, reflectivity or other useful function.

Although the preferred sleeve is preferably cut from sheet materials by a die-cutting process or the like, it could also be created by utilizing a number of different manufacturing processes including injection molding, pressure forming, casting or others such that the desired shape, geometry, structure, and durability are created. A thin layer of material could be added/laminated by a number of techniques such as in-mold transfer, gluing, heat lamination, silk screening, dipping, or others to create a surface texture and add strength. Likewise, this added layer could be eliminated such that the sleeve is formed by the above mentioned processes but does not have above mentioned laminations.

A confluence of disclosed geometry, construction, materials and features provide for a more comfortably worn, versatile, lighter weight, manufacturable and ergonomic sleeve and mating bottle. It can be constructed using inexpensive and easily obtained materials, assembled using conventional manufacturing equipment, produced easily and result in an aesthetically pleasing highly functional, versatile solution for its desired purpose.

FIG. 1 is a perspective view showing a preferred hydration belt assembly 10 with a pair of sleeves. Although two sleeves are shown, in other versions only one sleeve may be provided. As illustrated, a left-handed sleeve 15 and a right-handed sleeve 14 are each mounted to a waist belt 13 with an optional pouch 11 and optional buckle (or other form of closure) 9. The waist belt 13 is preferably woven elastic webbing or the like (similar to waistband elastic, but preferably sturdy enough to hold the weight of the desired carried items) that can be edge-bound with elastic if desired.

Figure 46:
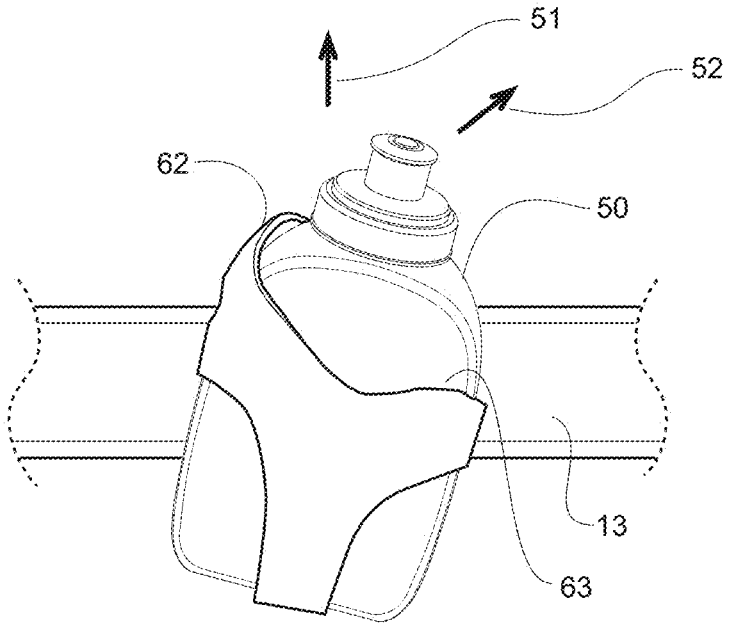
FIG. 46 is a front view of a sleeve that is representative of a preferred embodiment of the disclosed invention showing a preferred angle at which the preferred sleeve can be mounted to the preferred belt (or other mounting substrate, etc.). Bottle 50 is shown in the sleeve. Direction arrows 51 and 52 are shown in FIG. 46 and FIG. 47.
Figure 47:
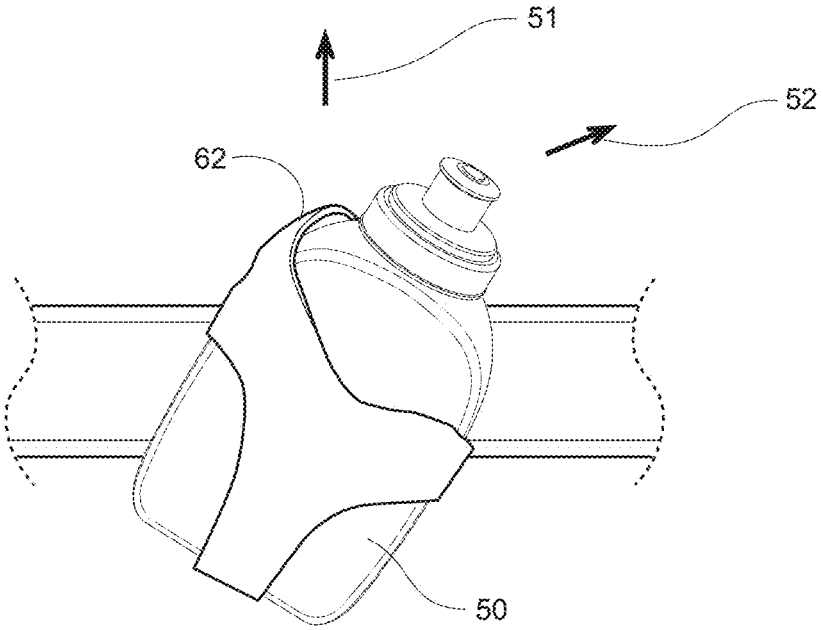
FIG. 47 is a front view of a sleeve that is representative of a preferred embodiment of the disclosed invention showing another preferred angle at which the preferred sleeve can be mounted to the preferred belt (or other mounting substrate, etc.). Bottle 50 is shown in the sleeve.

The sleeves can be placed as shown in FIG. 1, relatively upright in which the bottles are inserted and removed along a generally vertical axis, perpendicular to the plane of the belt. Alternatively the sleeves can be canted to a desired angle and fastened to the belt in a canted/angled position, such as shown in FIG. 46 and FIG. 47. Canting the sleeves can increase the security of the bottle being held in the sleeve. The degree of cant/tilt may vary with user preference, but ideally it would be slightly canted to the side in a range between 5 to 20 degrees from the vertical. A slight cant/tilt to the side can also be preferred for increasing bottle security, and most preferably, with reference to FIG. 1 the right sleeve 14 would be tilted clockwise while the left sleeve 15 would be tilted counterclockwise.

With reference to the right-handed sleeve 14 in FIG. 1, canting this sleeve in a preferred 10 to 35 degrees (clockwise) such that the upper sleeve opening and bottle top rotates away from the pouch 11 is preferred. Most preferably sleeve 15 would have a matching angle but rotated counterclockwise. See FIG. 46 and FIG. 47 for examples of preferred angles at which the preferred sleeve can be mounted to the preferred belt 13. In most cases increasing the cant of the bottle like shown in FIG. 47 will increase the security of the bottle held in the sleeve.

Figure 2:
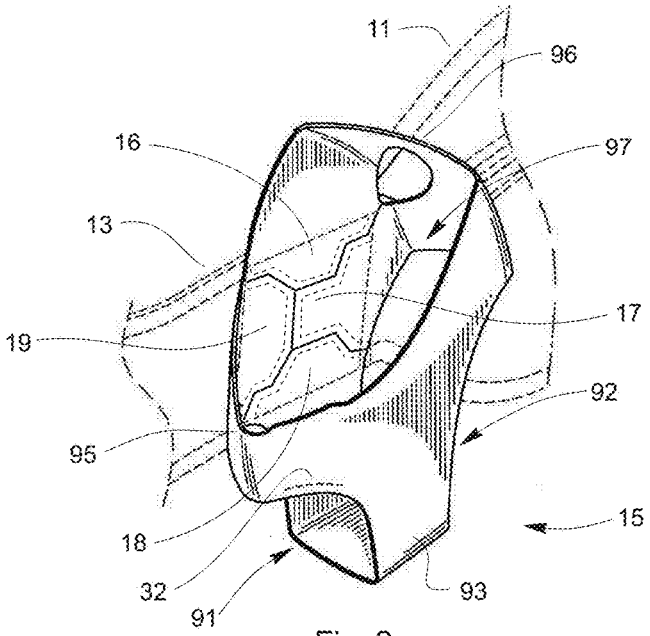
FIG. 2 is a perspective view of a sleeve that is representative of a preferred embodiment of the disclosed invention.

FIG. 2 is a perspective view of a left-handed sleeve 15 wherein the ends 16, 17, 18, 19 of sleeve 15 can be seen. Ends 16, 17, 18 and 19 are preferably matched together and then sewn or otherwise fastened to belting 13 (or the pouch 11 or some other surface to carry sleeve 15). The right-handed sleeve 14 is preferably formed in the same manner, but would be a mirror image of the sleeve shown in FIG. 2.

In general, the sleeve is formed by an outer sleeve sidewall forming an interior space, such as illustrated in FIG. 2. The outer sleeve sidewall further includes a central bottom portion 93 having a floor and opposing generally vertical portions in order to receive and retain a bottle by the floor and opposing vertical portions. Opposite sides adjacent the central bottom portion 93 are open, allowing lower left and right corners of a bottle to extend through the lower open portions. Thus, in the example of FIG. 2, a lower left corner 91 of the sidewall forms a first opening, while a lower right corner forms an opposite second opening 92. The first and second openings may be the same size, or one may be larger than the other. In the illustrated example, the second opening is larger than the first opening, such that the upper end of the second opening extends higher above the bottom of the central portion than the upper end of the first opening does.

The upwardly extending sidewalls of the sleeve terminate in an upper rim, thereby forming an upper opening 97 for access into the interior space defined by the sleeve. Most preferably, the upper rim is inclined, with one side considerably higher than the diametrically opposite side of the rim. In the illustrated example, the upper rim terminates at a first lower location 95 above the first lower opening 91, and at a second higher location 96 above the second lower opening 92. In addition, the upper second location 96 along the rim extends inward, partially over the interior space defined by the rim, in order to impede a bottle from being removed from the sleeve in a directly vertical direction.

Figure 3:
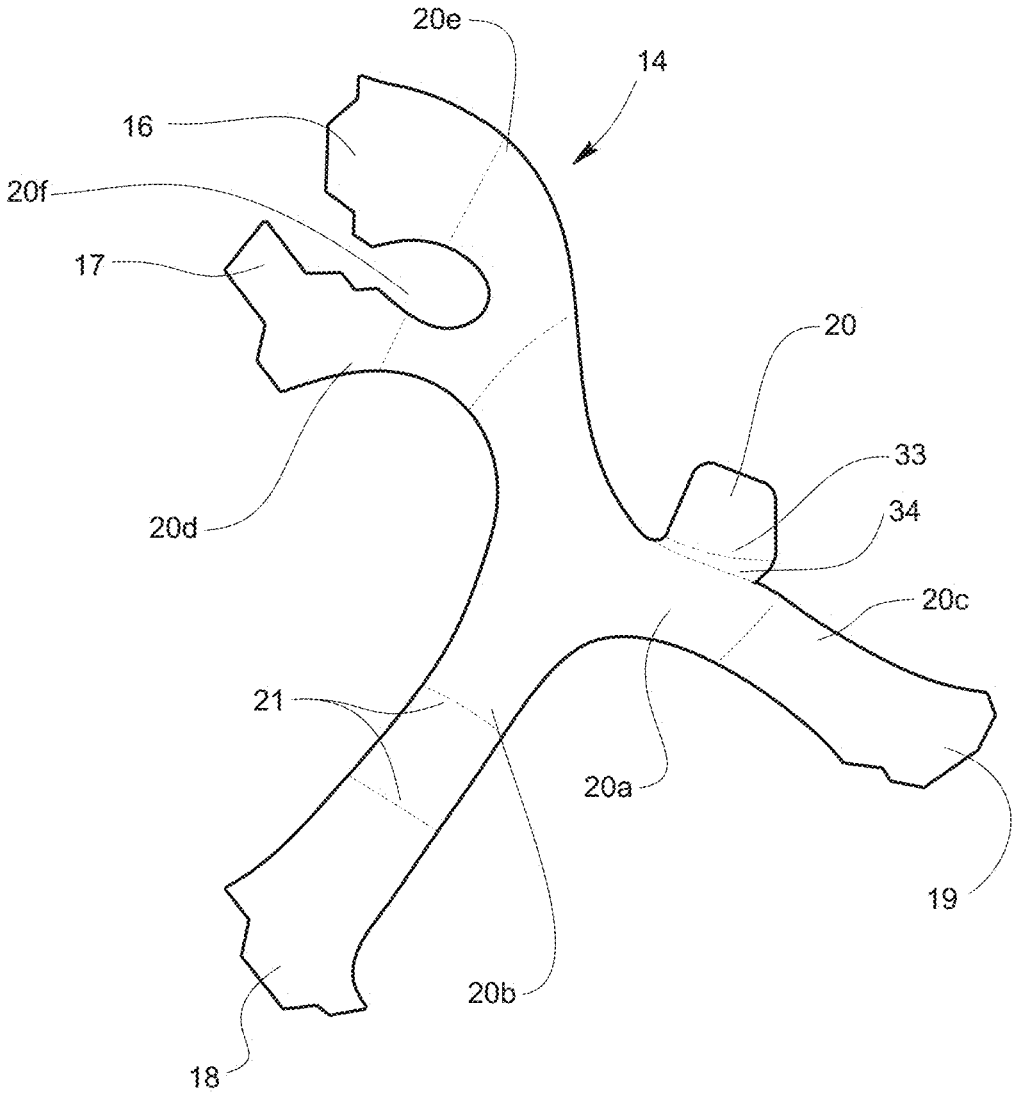
FIG. 3 is a front plan view showing a preferred sleeve, in a flat configuration after it has been die-cut or otherwise formed, but before it has been assembled into a sleeve and fastened to a belt.

FIG. 3 is a front plan view showing a sleeve 14, shown flat after it has been die-cut (or otherwise formed) but before it has been assembled and fastened in place to a belt or the like. Unformed/flat sleeve 14 as seen in FIG. 3 could be a right or left handed sleeve depending on which way it is bent along bend/score lines (two score lines are labeled 21 but others are shown as dotted lines in FIG. 3 and FIG. 4). Ends 16, 17, 18, and 19 mate together as shown in FIG. 2 in order to form the preferred sleeve shape.

In the example as illustrated in FIG. 3, and preferably when configured from sheet stock material, the preferred sleeve is configured initially with a central stem 20*b* which forms the central portion of the sidewalls and the floor. A right branch 20*c* forms the first portion of the rim as well as defining the upper boundary of the first lower opening. An upper left branch 20*e* defines the second portion of the rim, while a lower left branch 20*d* defines the upper boundary of the second lower opening. The arcuate gap 20*f* between the upper and lower left branches facilitates formation of the sleeve while enabling the second portion of the rim to extend inward, over the interior portion of the sleeve.

The preferred sleeve is preferably sized to snugly receive the bottle, yet loose enough such that the bottle can be simply removed from the sleeve. Preferably, a bottle detent flap 20 would be folded over along bend/score lines 33 and 34 and then fastened and folded over in place by stitching 32 shown in FIG. 2. Once folded inward, the detent flap 20 will be folded inward so that it is adjacent a sleeve sidewall portion 20*a* which forms an outer upper portion of the sleeve when it is fully assembled. The stitching 32 could be replaced by other fastening means such as heat-bonding, gluing, double-sided tape, snaps, hook and loop fasteners, feeding it through a hole or slot in the sleeve, or other means whereby the flap 20 provides its desired function of helping to hold the bottle securely in the preferred sleeve. The length and size of the flap 20 can be adjusted to adjust the desired pressure on the bottle which is a method of adjusting the desired level of security for holding the bottle.

Figure 6:
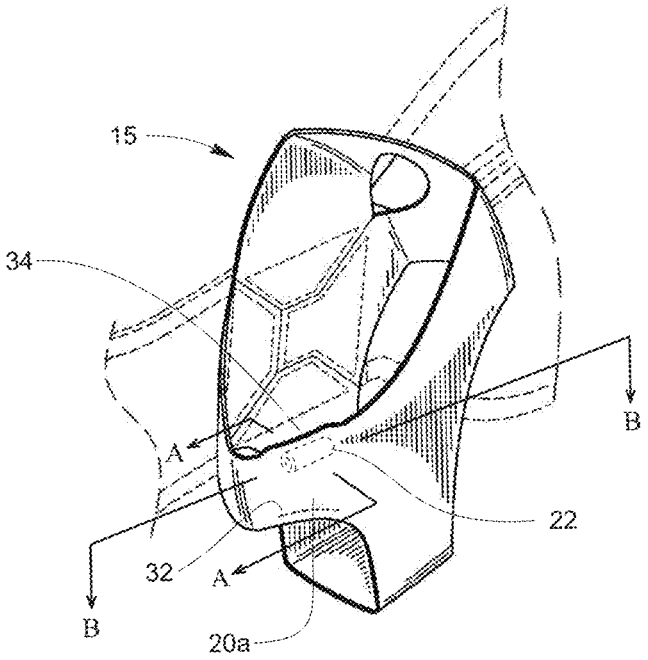
FIG. 6 is a perspective view of a preferred sleeve, with section cutting planes A-A and B-B shown and referenced in other figures.

The fold lines 33 and 34 are preferably positioned along a portion of the sleeve that serves as the outer upper rim of the opening of the sleeve once the sleeve is fully assembled, such as illustrated in FIG. 6. In the preferred version, the fold line is created such that the outer upper rim is horizontal or only slightly inclined in the vicinity of the fold line when the sleeve is fully assembled as shown in FIG. 6. The upper rim of the opening of the sleeve preferably inclines more sharply as it extends to the opposite side of the sleeve, as shown.

Figure 4:
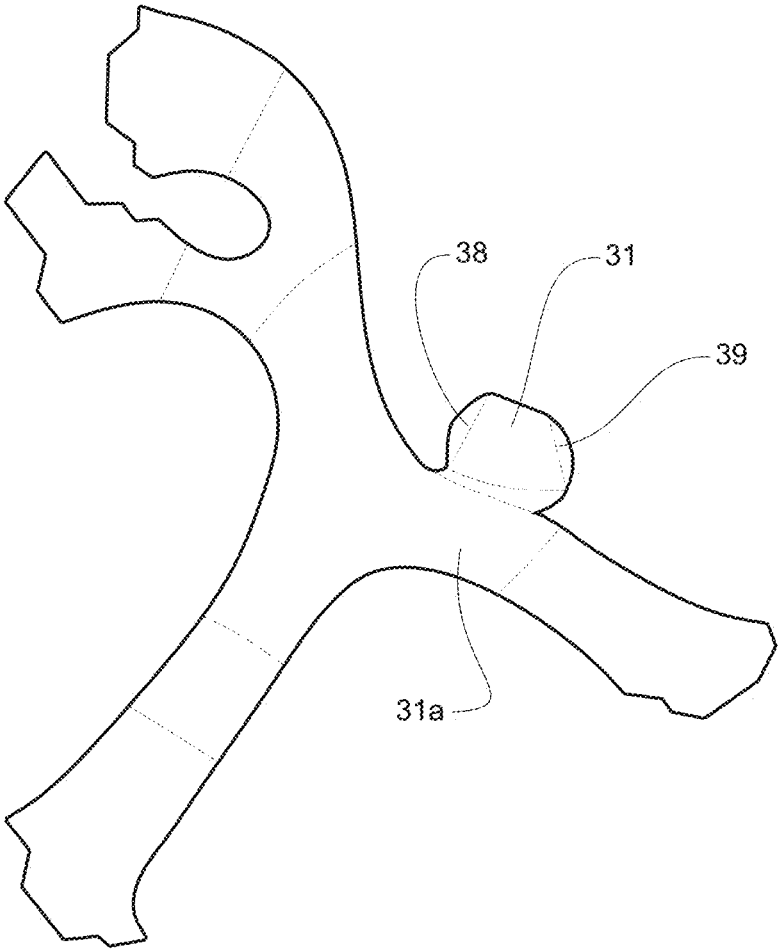
FIG. 4 is a front plan view of an alternate embodiment of a sleeve, in a flat configuration as with the sleeve of FIG. 3.

FIG. 4 is a front plan view showing a second embodiment of a sleeve, shown flat as it would be before it has been assembled and fastened in place to a preferred belt or the like. In this alternate version there is a differently-shaped detent flap 31 wherein dotted lines 38 and 39 represent bend lines along which the detent flap 31 can be formed, the free edges would preferably be bent inward (and away from the preferred bottle being held in the sleeve) wherein these bends would provide structure/stiffening for this area. The detent flap 31 is preferably bent over as described above for flap 20 and fasted similarly along 32. Once fully assembled, the flap is positioned on an inward sidewall 31*a* of the sleeve.

Figure 5:
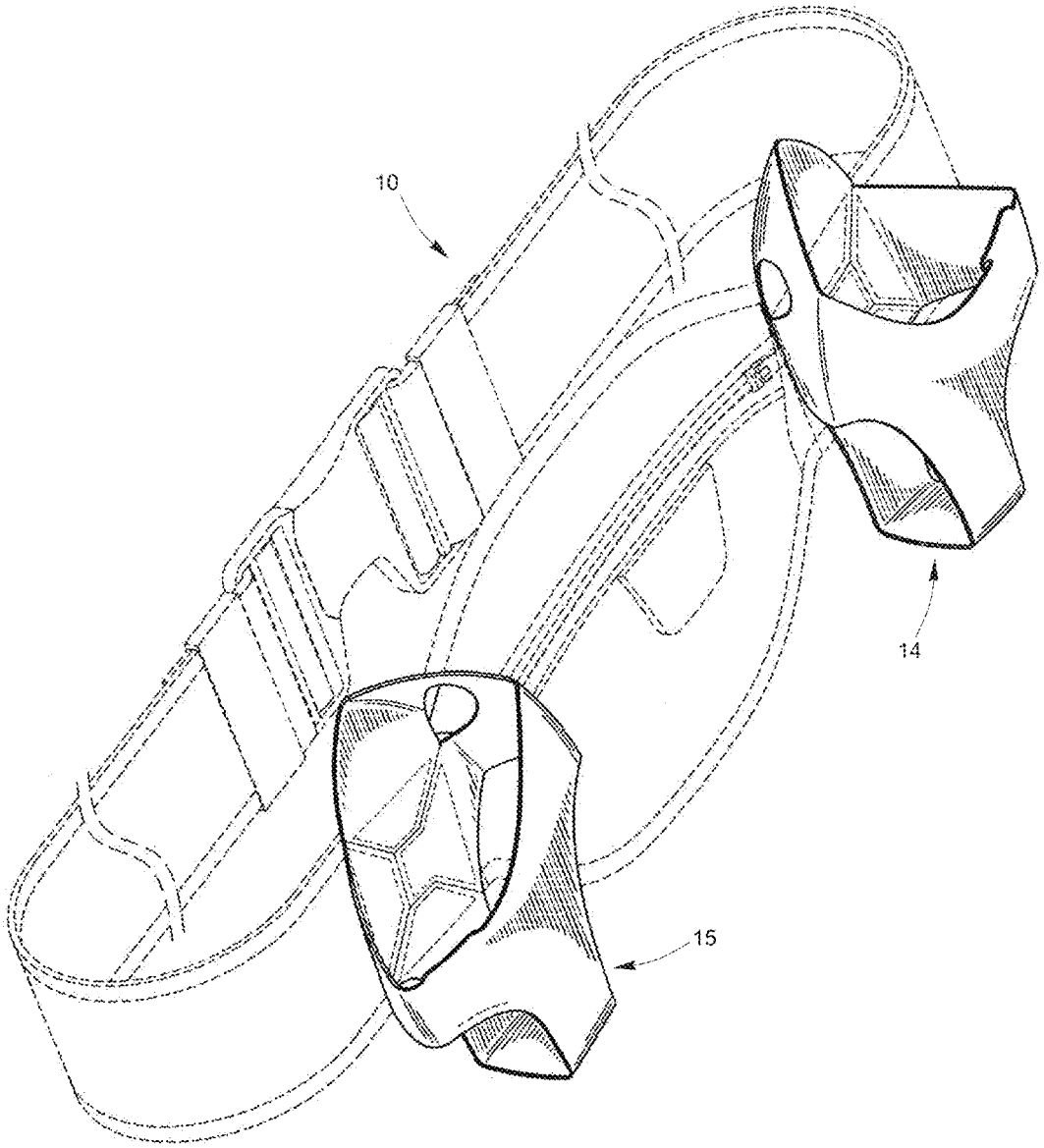
FIG. 5 is a perspective view of a preferred embodiment of the invention, including a left-handed sleeve 15 and a right-handed sleeve 14 mounted to a waste pouch or belt 10.

FIG. 5 is a perspective view of a preferred embodiment of the invention. The embodiment shows a left-handed version 15 and a right-handed version 14 of the preferred sleeve mounted to a waist pouch or belt 10.

FIG. 6 is a perspective view of a preferred sleeve, which in this example is a left-handed sleeve 15 shown attached to a belt in a partial cut-away view. Section cutting lines A-A and B-B are shown and are referenced in other figures discussed below. A detent form 22 is labeled and shown in broken lines as it is hidden from view in the perspective of FIG. 6, preferably trapped in the fold of the detent flap 20 (see FIG. 3) or the detent flap 31 (see FIG. 4). The detent form 22 operates as a spacer to thicken the sidewall of the sleeve in the area of the detent form as described below.

Figure 7:
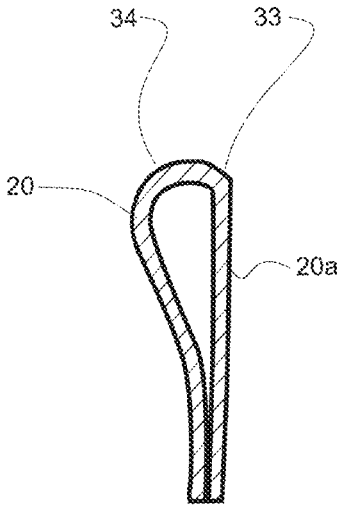
FIG. 7 is a section view taken through section A-A of FIG. 6.

FIG. 7 is a partial sectional view through section A-A of FIG. 6, showing the folded-over detent portion 20 in cross-section in the region of the front portion of the sleeve. FIG. 7 shows this preferred fold-over detent 20 positioned adjacent the outer sleeve sidewall portion 20*a*, without an optional detent form being attached. Note that the flat form as shown in FIG. 3 includes two adjacent fold lines 33, 34, and the pair of adjacent fold lines creates an inward separation space between the detent 20 and outer sidewall 20*a* at the upper rim of the sleeve in the vicinity of the fold lines. The shape of this area in this embodiment is preferably formed by the material of the sleeve folded over or otherwise formed and fastened/held in place at fastening line 32 (see FIG. 6) wherein a desirable geometry is formed to hold the bottle or other item in place in the preferred sleeve.

Figure 8:
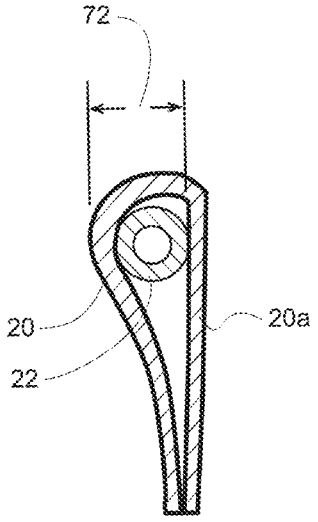
FIG. 8 is a section view taken through section A-A of FIG. 6. Protrusion distance 72 is labeled and referenced further below.

FIG. 8 shows section view (through section A-A of FIG. 6) with detent form 22 included and in which the detent form 22 is a short length of tubing, foam, rubber, plastic or other material placed and trapped (or fastened) between the detent 20 and outer sidewall 20*a*. Together, these components provide a desired geometry and flexibility of this area to better hold the bottle securely in place and prevent the bottle or other item from bouncing or moving around in the sleeve, while also allowing the bottle to be removed easily by a user during exercising or similar activities. This detent form 22 allows this area to reliably hold its shape such that this detent area is durable as well as flexible so that it helps to reliably hold the bottle or the like. The diameter of the exterior cross-section of the detent form 22 can be adjusted (and thus adjusting protrusion distance 72) to adjust the desired pressure on the bottle which is a method of adjusting the desired level of security for holding the bottle.

Figure 9:
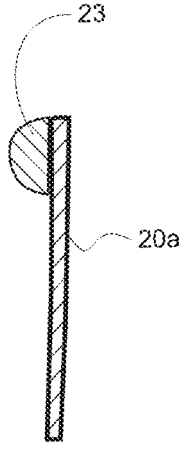
FIG. 9 is a section view taken through section A-A of FIG. 6.

FIG. 9 is a sectional view through section A-A of FIG. 6 wherein a third version of a portion of a front outer sidewall of a sleeve is shown in cross section. In this version, the detent form 23 could be made from an extrusion of foam or the like, it could be plastic, rubber or other similar materials fastened in place as shown in FIG. 9 such that the detent form 23 is held in same general area, on the inner side of the outer sleeve sidewall 20*a*.

Figure 10:
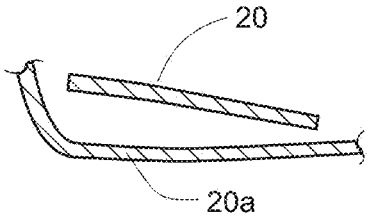
FIG. 10 is a partial sectional view taken through section B-B of FIG. 6 wherein the first embodiment of preferred geometry for a preferred sleeve is shown. Only part of the whole section is shown for simplicity of the drawing.

FIG. 10 is a section view through section B-B of FIG. 6 (of the first embodiment of this area, without an internal detent form or spacer, corresponding to the version of FIG. 7). Thus, there is no detent form in the space between the detent 20 and the outer sleeve sidewall 20*a*.

Figure 11:
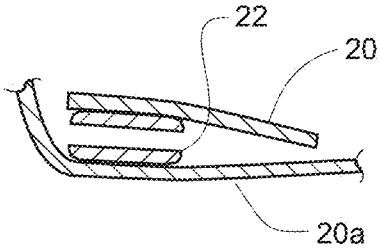

FIG. 11 is a section view through section B-B of FIG. 6 showing a view of the embodiment corresponding to FIG. 8. A preferred form of detent form 22 is shown in cross section as well as it can be better understood in this view how this form 22 can be placed in the folded over area as shown and described above such that 22 is preferably trapped and resides in this preferably folded over and fastened space (between the detent 20 and the outer sleeve sidewall 20*a*) such that it functions as intended to help to form the appropriate geometry and preferred characteristics such that it applies a holding pressure and functions to hold the preferred bottle in place. Detent form 22 could be solid, tubular or otherwise shaped such that it functions to hold the bottle in place (although it is preferably tubular such as in the illustrated example).

Figure 12:
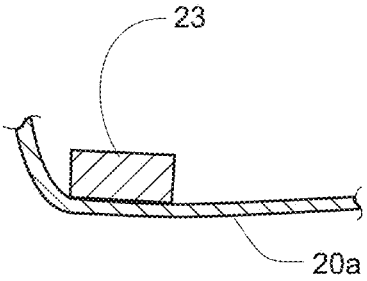

FIG. 12 is a section view through section B-B of FIG. 6 (corresponding to the version shown in FIG. 9, which is a different section view of this same third embodiment). As discussed above, in this version there is no detent 20 and the detent form 23 is attached to the outer sleeve sidewall 20*a*.

Figure 13:
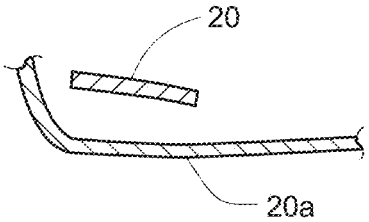

FIG. 13 is a section view through section B-B of FIG. 6 wherein a fourth embodiment of preferred geometry for a preferred sleeve is shown. This fourth embodiment in FIG. 13 shows how a detent flap 20 adjacent the outer sleeve sidewall 20*a* can be relatively narrow in width (but it could widen farther down inside the sleeve similar to the embodiment of this detent flap shown in FIG. 4).

Figure 14:
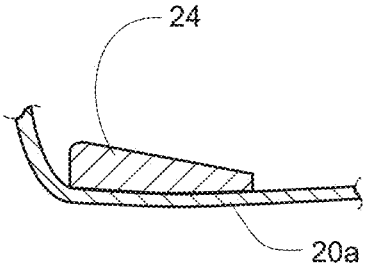

FIG. 14 illustrates another embodiment of how a detent form 24 attached to a sleeve sidewall 20*a* could taper in cross-section, being wider at an outer peripheral portion of the sleeve and narrower at an inner portion of the sleeve, which could be desirable in some cases to apply the appropriate pressure to the preferred bottle.

Figure 15:
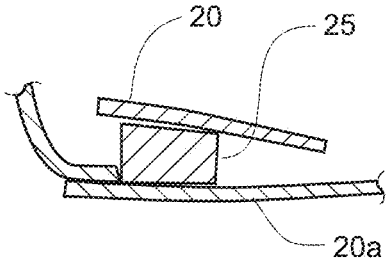
Figure 19:
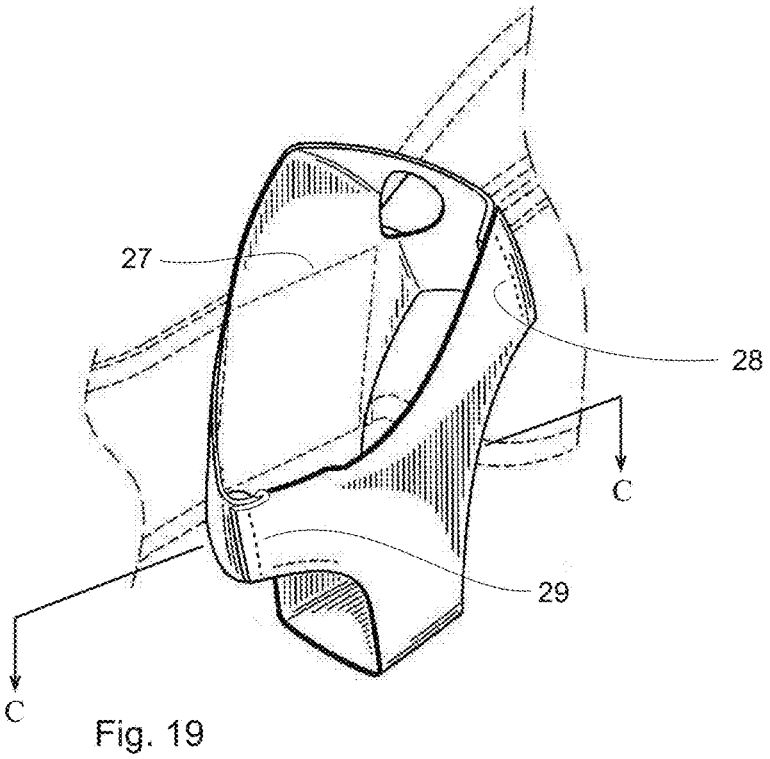
FIG. 19 is a perspective view of a sleeve that is representative of an embodiment of the disclosed invention. Section cutting plane C-C is shown and is referenced in other figures.

FIG. 15 is a section view through section C-C of FIG. 19 wherein another embodiment of preferred geometry for a preferred sleeve is shown. In this version, a detent form 25 (made from foam, plastic, rubber or the like) is preferably trapped or fastened in place in the fold-over as discussed above. FIG. 15 further shows how a preferred sleeve of the embodiment as shown in FIG. 19 can be assembled by overlapping the sides at the edge of the front sidewall 20*a* to form a "T"-shaped (or "Y"-shaped) front panel (see FIG. 19), with stitching/fastening or the like along stitch/fastening lines 28 and 29 as shown in FIG. 19.

Figure 16:
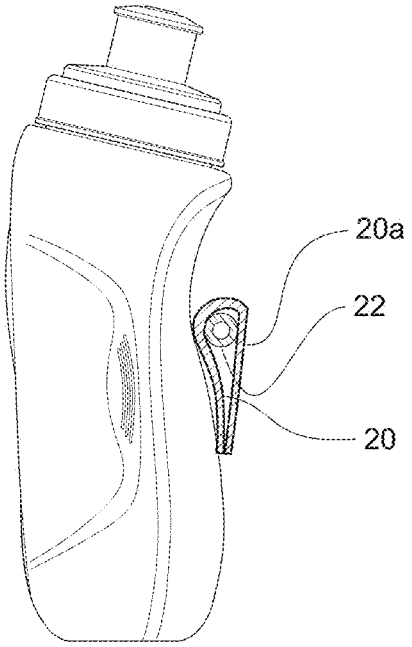
FIG. 16 is a section view cut through section A-A of FIG. 6 wherein the second embodiment of preferred geometry for a preferred sleeve is shown and further wherein a preferred bottle is shown such that it can be seen how a preferred bottle can fit with a preferred embodiment of the disclosed preferred sleeve. Side views of bottles in FIGS. 16, 17, and 45 are shown not in cross-section.

FIG. 16 illustrates a side view of a bottle adjacent a partial sectional view cut through section A-A of FIG. 6, in which the detent flap 20 and front sleeve sidewall 20*a* (corresponding to FIG. 8) are positioned adjacent the bottle to illustrate how a preferred bottle can fit with a preferred embodiment of the sleeve. It can be further seen in FIG. 16 how detent form 22 combined with the detent flap 20 fold-over (as shown in this figure in cross-section) is designed to nest with the shape of the preferred bottle and trap the preferred bottle in place such that it is securely held in the preferred sleeve.

Figure 17:
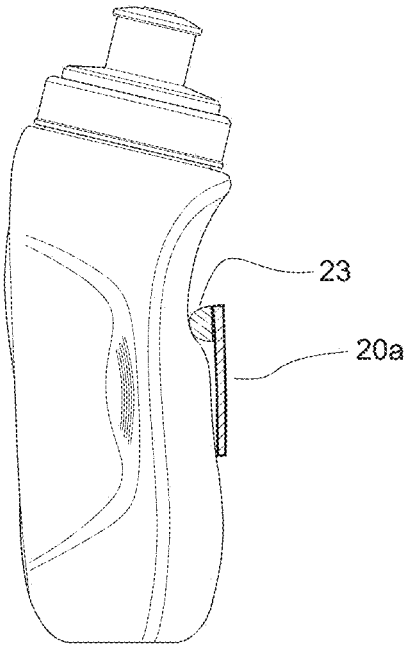
FIG. 17 is a section view cut through section A-A of FIG. 6 wherein the third embodiment of preferred geometry for a preferred sleeve is shown and further wherein a preferred bottle is shown such that it can be seen how a preferred bottle can fit with a preferred embodiment of the disclosed preferred sleeve.

FIG. 17 is a section view cut through section A-A of FIG. 6 wherein the third embodiment also shown in FIGS. 9 and 12 and another version/embodiment in FIG. 14 of preferred geometry for a preferred sleeve is shown and further wherein a preferred bottle is shown (bottle is shown in side view not shown in cross-section). In this illustration, the detent form 23 and front sleeve sidewall 20*a* combine to engage a preferred bottle so that the bottle is nested within the sleeve whereby a trapping action is achieved to secure the bottle as intended.

Figure 18:
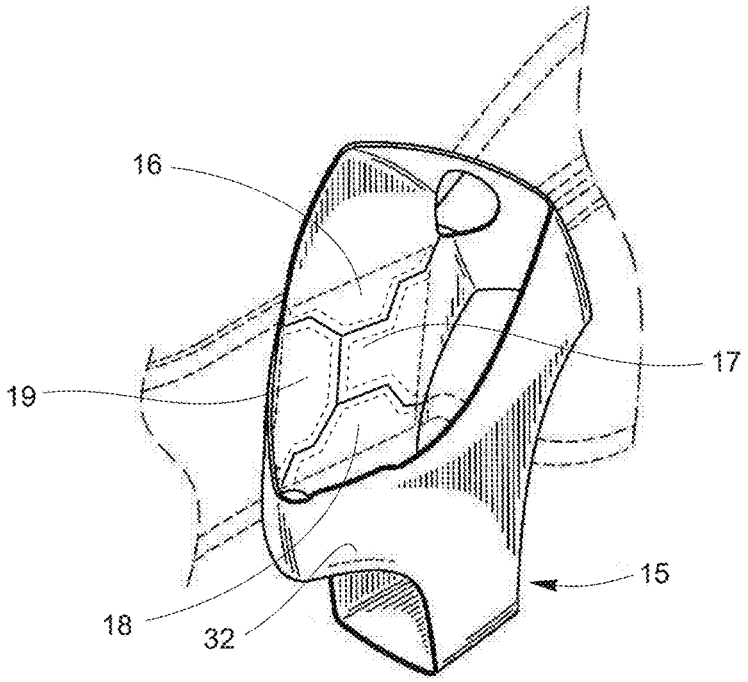
FIG. 18 is a perspective view of a sleeve that is representative of a preferred embodiment of the disclosed invention.

FIG. 18 is a perspective view of a preferred sleeve, fully assembled. It can be readily seen in this view how the un-formed, un-assembled versions of this sleeve, embodiments as seen in FIG. 3 and FIG. 4, can be formed/folded (in some cases preferably along fold/score lines) and ends 16, 17, 18, 19 placed together like pieces of a puzzle and fastened together in place in a repeatable manner.

FIG. 19 is a perspective view of an alternate sleeve, without incorporating the puzzle-assembly end configuration. Section cutting line C-C is shown and is referenced in FIG. 15. FIG. 19 shows a version of the sleeve wherein stitch or other fastening means 27 fastens a back panel of the sleeve to a desirable belt/pouch or the like. In this illustrated version, this shown back panel (that is, the portion corresponding generally to the region of the stitch 27) is not formed from a number of ends coming together (like the embodiment shown in FIG. 18), instead a front "T" or "Y"-shaped portion is bent in place wherein it is connected to a formed back portion to form the sleeve along fastening/stitch lines 28 and 29.

Figure 20:
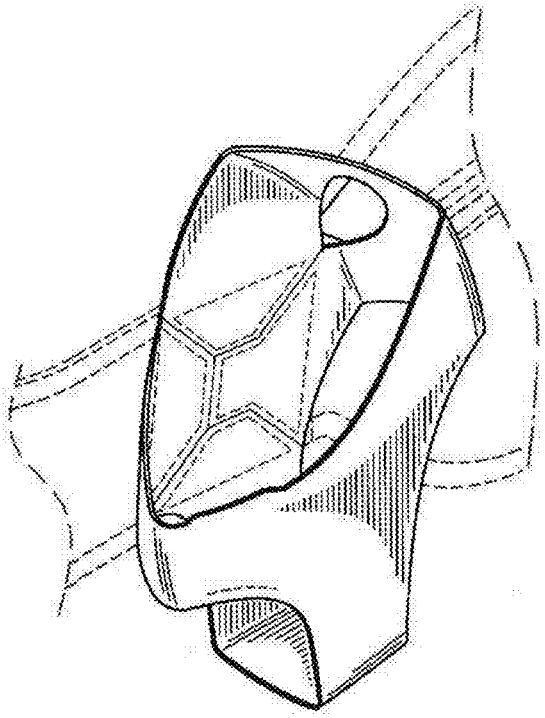
FIG. 20 is a perspective view of a sleeve that is representative of a preferred embodiment of the disclosed invention.

FIG. 20 is a perspective view of a sleeve that is representative of a preferred embodiment of the disclosed invention. FIG. 20 shows a version in which the back panel of the sleeve can be formed/cut such that it fits together so that it can be fastened in this manner to a preferred belt/pouch or other mounting surface such that the sleeve can be repeatably manufactured and formed in a reliable dimensionally stable and durable manner.

Figure 21:
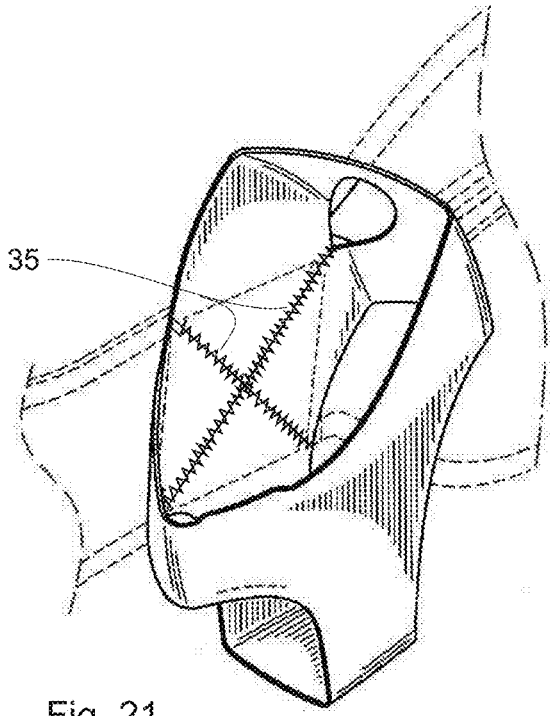
FIG. 21 is a perspective view of a sleeve that is representative of a preferred embodiment of the disclosed invention.

FIG. 21 is a perspective view of a sleeve that is representative of a preferred embodiment of the disclosed invention. FIG. 21 shows a variation/embodiment of how the back panel of the sleeve can be formed/cut such that it fits together and is fastened together via preferred stitch lines 35 (or other fastening means such as with rivet, ultrasonic welding, heat bonding, glue, etc.).

Figure 22:
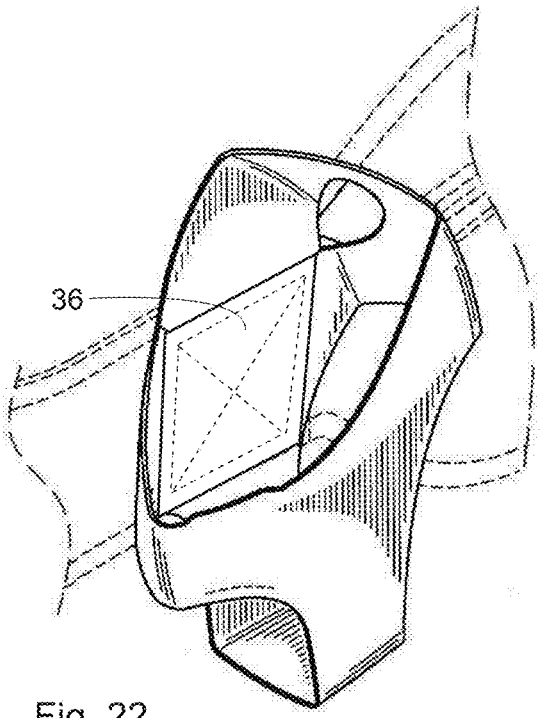
FIG. 22 is a perspective view of a sleeve that is representative of a preferred embodiment of the disclosed invention.

FIG. 22 is a perspective view of a sleeve that is representative of a preferred embodiment of the disclosed invention. FIG. 22 shows how a secondary panel 36 can be added to sandwich the back panel of the sleeve to the desirable mounting substrate (belt/pouch or the like) wherein the sleeve can be formed similar to the construction of back panel formed by ends 16, 17, 18, 19 end as shown in FIG. 18, but additional panel 36 can be added to cover and further strengthen this back panel area. Panel 36 can be made from similar material as the sleeve itself although it may be advantageous to make 36 from fabric, vinyl, rubber, plastic, felt or the like die-cut or otherwise formed.

Figure 23:
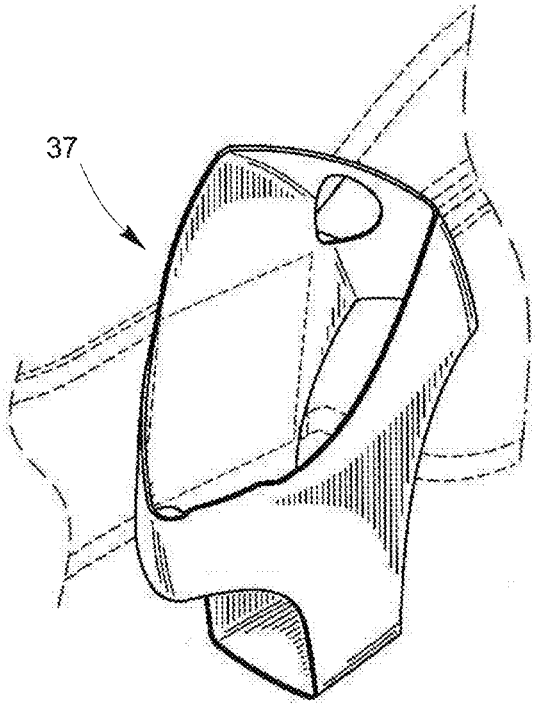
FIG. 23 is a perspective view of a sleeve that is representative of a preferred embodiment of the disclosed invention.

FIG. 23 is a perspective view of a sleeve 37 that is representative of a preferred embodiment of the disclosed invention. FIG. 23 shows sleeve 37 wherein the sleeve embodiment shown is formed without joining ends together, 37 is preferably injection molded or otherwise formed in a pre-formed preferred sleeve shape (preferably with integrated detent form shaped area) such that it only would then be fastened to the desirable mounting substrate (belt/pouch or similar item). Although this may be desirable in some situations generally this sort of formation has its challenges such as undesirable strength-to-weight ratio, aesthetic challenges, and other manufacturing issues and potential challenges. In some applications a sleeve molded or otherwise fabricated without seams in this manner shown in FIG. 23 could be desirable. A detent feature as described above may be incorporated.

Figure 24:
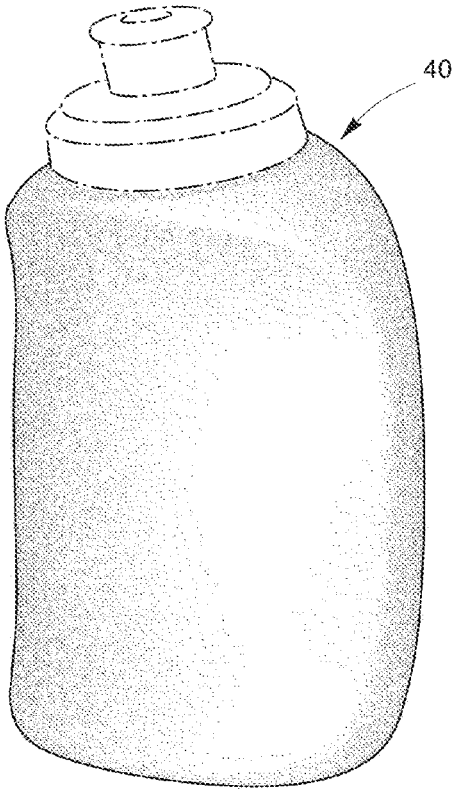
FIG. 24 is a front perspective view of a first preferred embodiment of a bottle that is preferably designed to fit with the preferred sleeve of the preferred invention.

FIG. 24 is a front perspective view of a first preferred embodiment of a bottle 40 that is preferably designed to fit with one or more of the sleeves described above. A preferred bottle is molded in a manner to nest with the sleeve in a such that the bottle will be firmly held in place, yet be easily removable to provide ready-access to the preferred bottle or the like.

Figure 25:
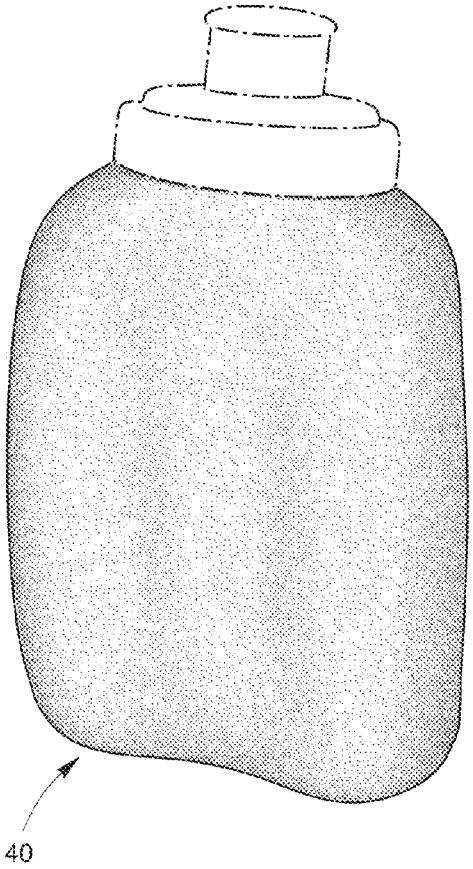
FIG. 25 is a back perspective view of a first preferred bottle embodiment that is preferably designed to fit with the preferred sleeve of the preferred invention.

FIG. 25 is a back perspective view of the bottle 40 of FIG. 24.

Figure 26:
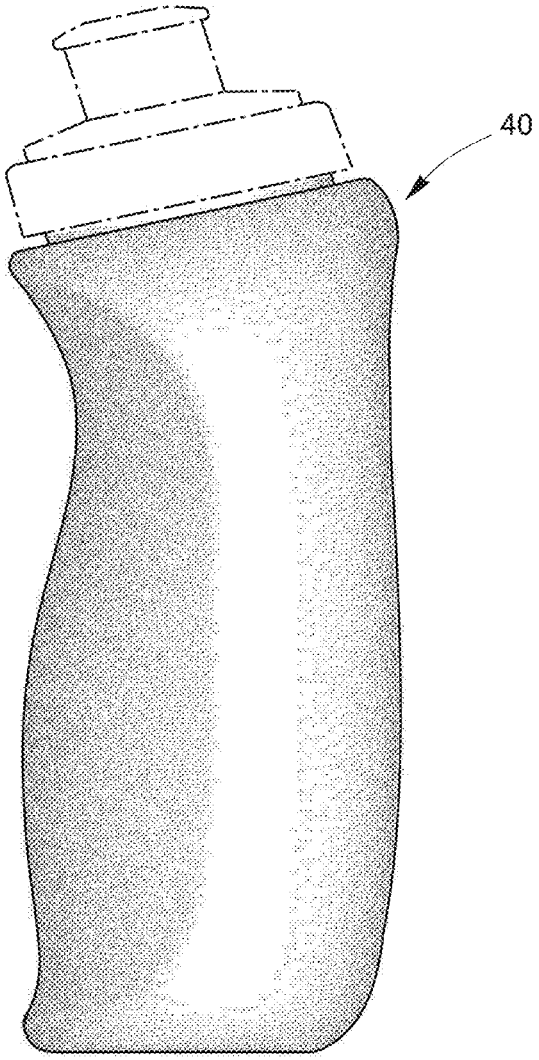
FIG. 26 is side view of a first preferred bottle embodiment that is preferably designed to fit with the preferred sleeve of the preferred invention.

FIG. 26 is side view of the bottle 40 of FIG. 24.

Figure 27:
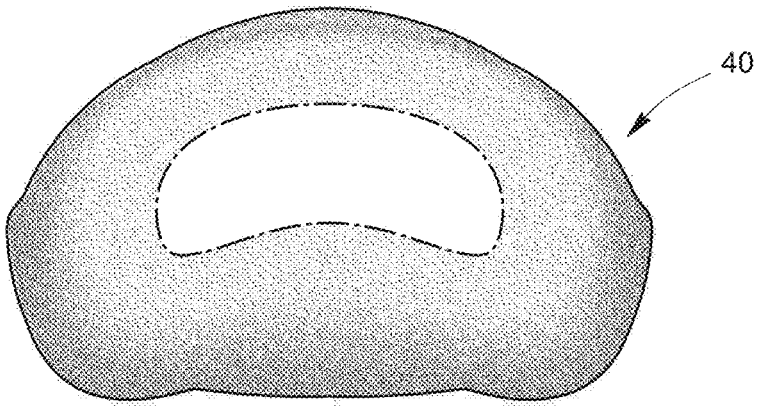
FIG. 27 is a bottom view of a first preferred bottle embodiment that is preferably designed to fit with the preferred sleeve of the preferred invention.

FIG. 27 is a bottom view of the bottle 40 of FIG. 24.

Figure 28:
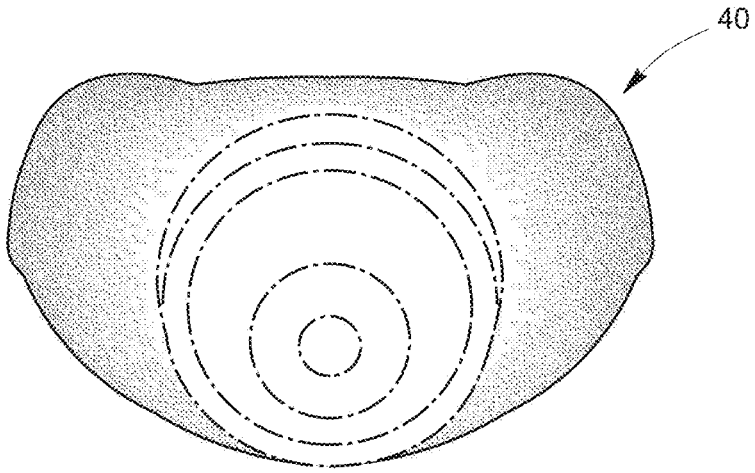
FIG. 28 is a top view of a first preferred bottle embodiment that is preferably designed to fit with the preferred sleeve of the preferred invention.

FIG. 28 is a top view of the bottle 40 of FIG. 24.

Figure 29:
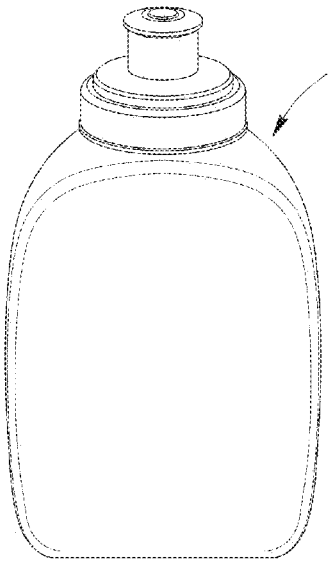
FIG. 29 is a front view of a second preferred bottle embodiment that is preferably designed to fit with the preferred sleeve of the preferred invention.

FIG. 29 is a front view of a second version of a preferred bottle 50 that is preferably designed to fit with one or more of the sleeves as described above.

Figure 30:
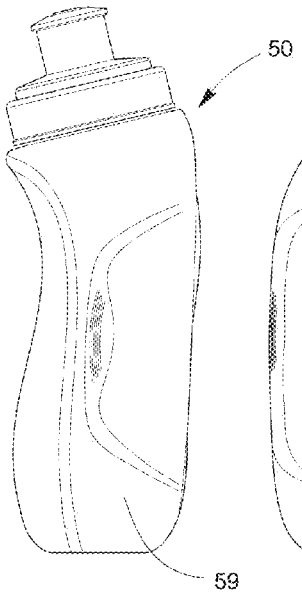
FIG. 30 is a side view of a second preferred bottle embodiment that is preferably designed to fit with the preferred sleeve of the preferred invention.

FIG. 30 is a side view of the bottle 50 of FIG. 29. Raised area 59 is designed to fit with the preferred sleeve to secure the bottle in the sleeve.

Figure 31:
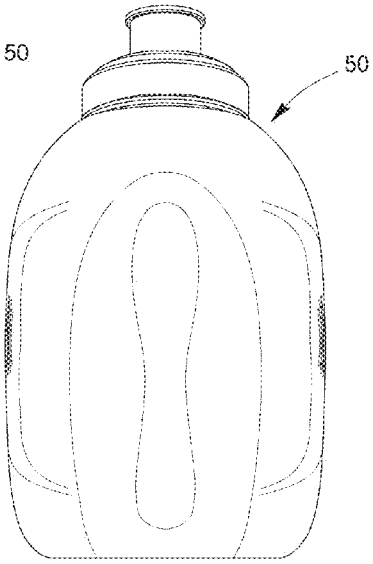
FIG. 31 is a back view of a second preferred bottle embodiment that is preferably designed to fit with the preferred sleeve of the preferred invention.

FIG. 31 is a back view of the bottle 50 of FIG. 29.

Figure 32:
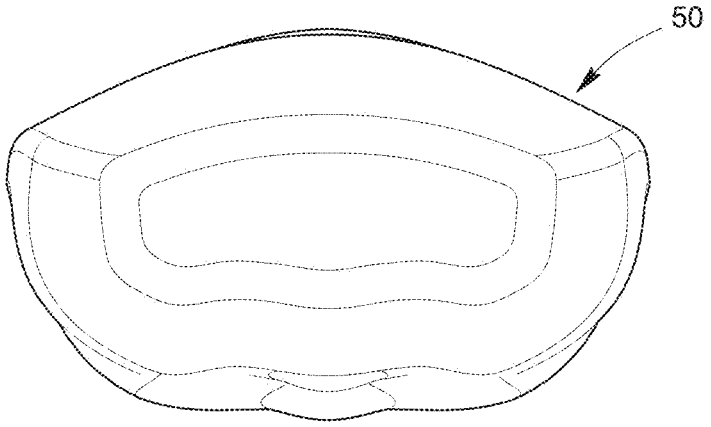
FIG. 32 is bottom view of a second preferred bottle embodiment that is preferably designed to fit with the preferred sleeve of the preferred invention.

FIG. 32 is bottom view of the bottle 50 of FIG. 29.

Figure 33:
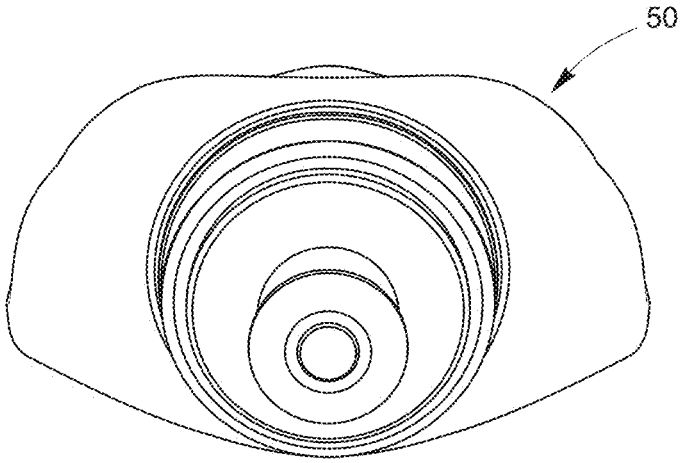
FIG. 33 is top view of a second preferred bottle embodiment that is preferably designed to fit with the preferred sleeve of the preferred invention.

FIG. 33 is a top view of the bottle 50 of FIG. 29.

Figure 34:
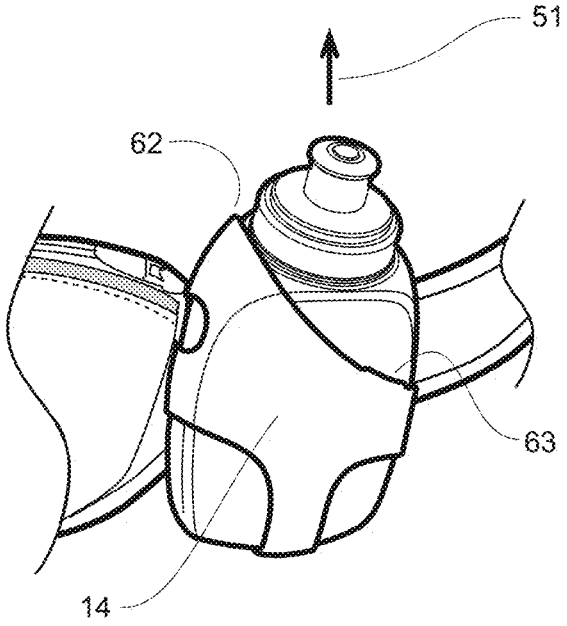
FIG. 34 is a perspective view of a sleeve that is representative of a preferred embodiment of the disclosed invention. Direction arrow 51 is shown. A pouch and belt are shown cut-away in this and other figures to simplify the drawings.

FIG. 34 is a perspective view of a preferred sleeve 14, with a pouch and belt shown cut-away to simplify the drawings. The bottle is removable from the sleeve 14 in the direction of arrow 51. FIG. 34 shows how the combination of the preferred sleeve geometry along with the preferred bottle shape provides for a bottle/sleeve system that is secure yet allows the bottle to be easily removable. Direction arrow 51 indicates an upward direction for removal of the bottle, while direction arrow 52 (see FIG. 35) shows the direction of removal of the bottle in an example in which the sleeve is canted on the belt or pouch. For running, jogging, or exercising the preferred bottle as described stays securely in place in the sleeve, the prevalent forces being in the direction of arrow 51 and in the opposite direction of 51 (up and down jarring movement), while if a user desires access to a bottle held in the sleeve the user simply turns/pulls the bottle slightly sideways and up (as discussed below).

In addition, the preferred geometry of the disclosed sleeve is designed to allow the bottle to angle/cant to the side slightly because the sleeve is preferably open along the bottom edges, providing a first opening 91 at the bottom left side and a second opening 92 at the bottom right side, with a central support 93 at the bottom and between the left and right openings (see FIG. 2). The lower left and right openings cooperate to allow the bottom edge of the bottle 61 to tilt sideways when turned by a user to protrude through an upper opening 97 in the sleeve. Most preferably, the upper opening 97 is bounded by a lower portion of the rim 95 adjacent the left side and a higher portion of the rim 96 at the right side, with the right side of the rim forming a shoulder which extends inward over the interior of the sleeve. Accordingly, the bottle is removable from the sleeve by tilting the upper portion of the bottle slightly in a direction from the upper right portion of the rim 96 toward the lower left portion of the rim 95 in order to disengage the upper shoulder of the bottle from the shoulder of the rim. Thus, with reference to FIGS. 35 (and 38), a lower bottle edge 61 is shown protruding through a lower opening 92 (in the case of FIG. 35, a right-hand sleeve 14 is shown, which is inverted from the left-hand sleeve of FIG. 2) because the bottle has been tilted slightly to facilitate removal from the sleeve 14.

Further, this slight canting of the bottle (which is further facilitated by the sleeve/bottle geometry and bottle/sleeve materials being slightly flexible) also allows the bottle to be freed from formed surface or upper shoulder 62 which preferably mates with a top/side/back surfaces of the bottle, wherein when the bottle clears this edge 62 by virtue of the disclosed geometry of the preferred sleeve, the bottle can be removed by pulling in direction arrow 52. This slight tilt/cant and pull is a completely intuitive and natural motion when the preferred sleeves are preferably placed as disclosed herein. It should be noted that it is preferred to integrate preferred sleeves such that the natural motion of a user's arm is taken into account whereby the sleeves are preferably placed such that they work with the natural motion of the arm when a user reaches to remove a bottle, thus removing a bottle is a simple and seamless/natural/intuitive action.

Figure 35:
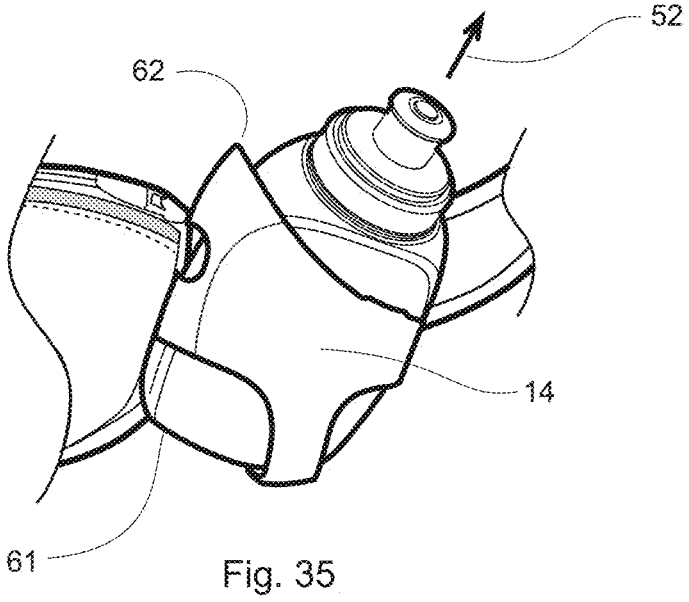
FIG. 35 is a perspective view of a sleeve that is representative of a preferred embodiment of the disclosed invention. Direction arrow 52 is shown.

FIG. 1 shows an example of a preferred integration of the sleeve in an example hydration belt 10 where it can be seen, if a user wears the hydration belt 10 with the pouch 11 in the small of his/her back it is a natural and intuitive action for this user to reach back and slightly twist a bottle to the side then pull the bottle out of the sleeve as further illustrated in FIG. 35 and described above. The slight twist is virtually imperceptible and thus if a user just reaches back and pulls in a natural fashion this twist and release is achieved by a natural arm motion and thus the bottle is released without any other action. An advantage of the disclosed bottle and sleeve system being that it automatically locks the bottle in place so that it does not fall out during running/jarring activity while allowing the bottle also to be removed by simply and easily lifting on the bottle with a natural and simple motion.

The disclosed sleeve/bottle and detent or locking geometry of the sleeve/bottle stops the bottle from falling out and bouncing yet does not require the user to do anything extra other than lift the bottle out of the sleeve. It should be noted that although the disclosed detent feature is labeled as a "detent" it could function as a detent per se and have a slight over-center locking type action by adjusting the snugness of the disclosed geometry as well as making detent form 22 larger in diameter, for example, but the disclosed invention has the ability to lock the bottle in place without a noticeable detent feel (if desired) such that the bottle can be just pulled out of the sleeve without feeling much if any resistance or "detent" feel. This is accomplished by making the geometry of the disclosed bottle/sleeve snug but not tight and a method for increasing or decreasing the amount of detent the user feels is by respectively increasing or decreasing the effective protrusion distance 72 labeled in FIG. 8 which can be adjusted in a number of ways, one example is by changing the diameter of 22 (other ways include changing the bottle shape as can be seen in FIG. 17, increasing/decreasing the size of 62, changing the detent shape, etc.).

And further replacing the bottle is also a simple, natural motion—if a user just places the bottle in the mouth of the sleeve and presses, the sleeve accepts the bottle back in place wherein it is secured therein by the disclosed geometry. The combination of the disclosed geometry for the preferred sleeve allows the disclosed preferred bottle to be not only securely held during vigorous, jarring, running activity or the like, the geometry as disclosed actively holds the bottle in place such that it does not shift/bounce during jarring activity and only does the bottle come free easily from the system when a user actively removes the bottle as desired/described.

Further the preferred material thickness and firm but flexible laminated sheet material that is preferably used to manufacture the sleeve is tuned in thickness and rigidity such that it flexes very little such that it transfers the weight of the water or the like held in the bottle in a virtually seamless and bounce-free manner to the user when mounted on a flexible elastic hydration-type belt or the like, thereby a very comfortably worn, intuitively useable hydration belt can be achieved by the disclosed herein.

Further it should be noted that the placement of the preferred bottle detent area 63 (wherein the detent fold-over, detent form, and/or other preferred detent feature as disclosed above resides) is preferably placed substantially opposite preferred formed surface 62 across the mouth of the sleeve that receives the bottle. Whereby, this novel geometry along with mating bottle allows for the preferred bottle to be held in such a manner that is both simply user releasable but also highly secure.

Figure 36:
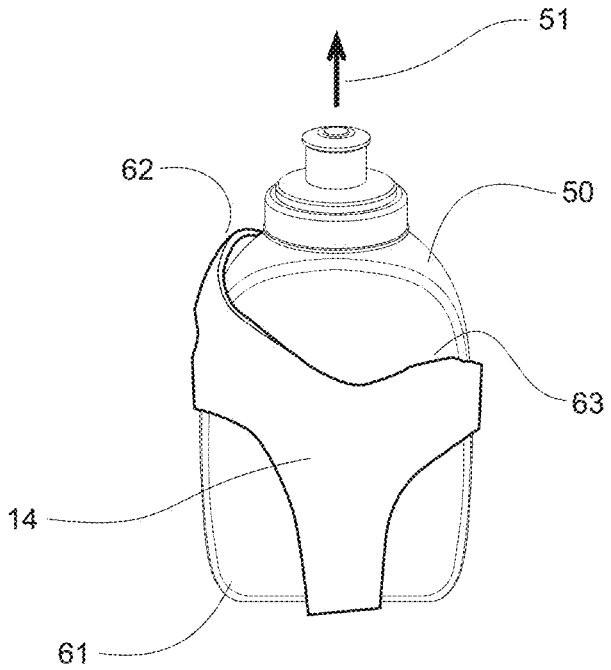
FIG. 36 is a front view of a sleeve that is representative of a preferred embodiment of the disclosed invention, bottle 50 is shown in the sleeve. A sleeve is shown removed from belt or the like for drawing simplicity. Direction arrow 51 is shown.

FIG. 36 shows a preferred sleeve, without being shown attached to a belt. As illustrated, the sleeve 14 includes an upper shoulder 62 for retaining a bottle 50 having a lower bottle edge 61. The detent form and/or detent flap is provided in the detent area 63, positioned at a location along the upper sleeve opening that is diametrically opposite the upper shoulder 62.

Figure 37:
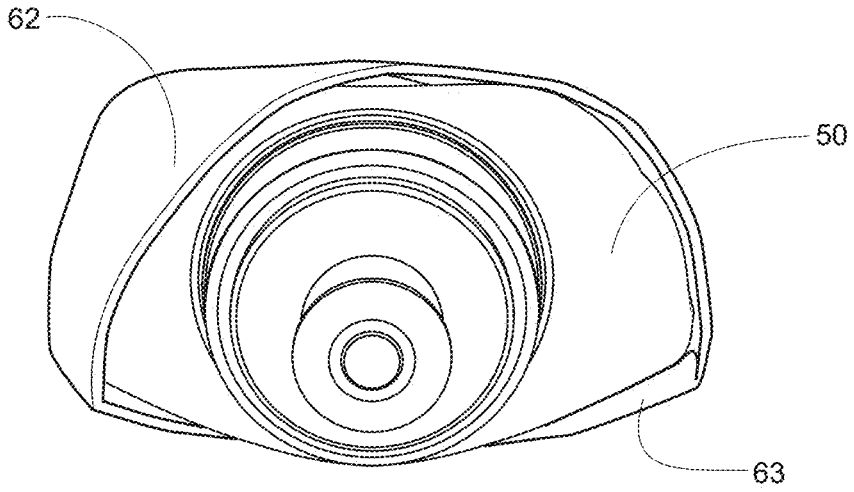
FIG. 37 is a top view (enlarged to show detail) of a portion of the sleeve (and bottle 50) shown FIG. 36. Sleeve is shown removed from belt or the like for simplicity.

FIG. 37 is a top view of the sleeve and bottle shown in FIG. 36 wherein it can be seen in FIG. 36 in combination with FIG. 37 how the preferred bottle is trapped from removal from the sleeve when a force in the direction 51 is applied. FIG. 37 shows how the preferred sleeve preferably wraps around a top shoulder of the bottle because the upper formed surface or shoulder 62 overlies a portion of the upper shoulder of the bottle. The sleeve shoulder 62 is also illustrated in FIG. 37 as being diametrically opposite the sleeve shoulder 62, with both features positioned along the upper rim opening of the sleeve. The shoulder 62, in combination with the bottle detent area 63, create a very reliable system for securely holding a bottle or the like yet while making that bottle or other item simply user-accessible.

Figure 38:
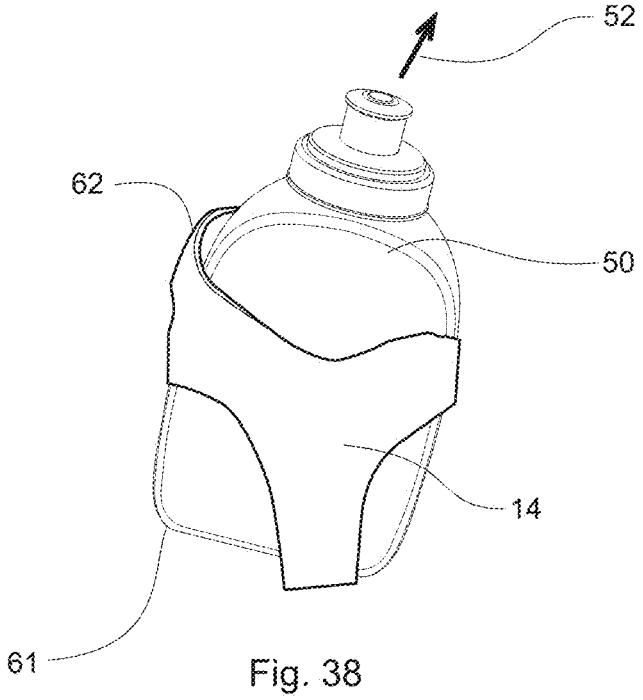
FIG. 38 is a front view of a sleeve that is representative of a preferred embodiment of the disclosed invention bottle 50 is shown in the sleeve. The sleeve is shown removed from belt or the like for simplicity. Direction arrow 52 is shown.

FIG. 38 is a front view of a sleeve 14 with a preferred bottle 50 is shown in the sleeve. Sleeve is shown removed from belt or the like for simplicity. Direction arrow 52 illustrates the approximate angle at which the bottle can be easily removed. Note that the direction of the arrow 52 is angularly offset (in this example, to the right) from an axis that would extend through the center of the bottle, and the center of the sleeve, when the bottle is resting fully within the sleeve. Thus, the bottle is shown turned slightly in the sleeve by a user, with the bottle lower corner 61 protruding though a lower left open area of the sleeve, and therefore from this position the bottle can be simply removed as previously described in detail.

Figure 39:
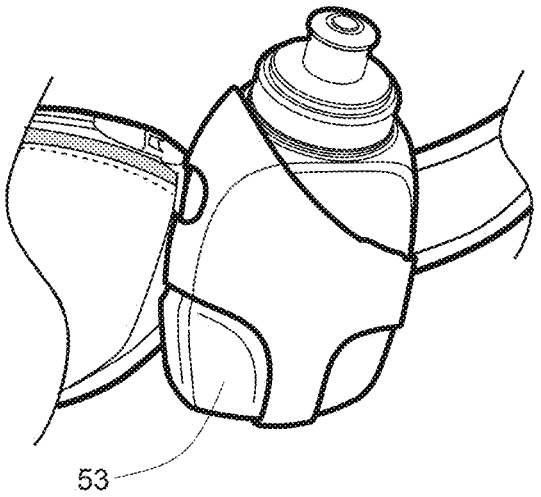
FIG. 39 is a perspective view of a sleeve that is representative of an alternate embodiment of the disclosed invention.

FIG. 39 is a perspective view of a sleeve that is representative of an alternate embodiment of the disclosed invention in which a lower left corner of the bottle includes a bulged area 53. The bulged area includes an upper shelf extending along a path that closely follows the path of the lower left opening 91 of the sleeve (see FIG. 2). Thus, when the bottle is positioned in the sleeve, the shelf formed on the bulged area engages the opening of the sleeve to help lock the bottle in the sleeve.

Figure 40:
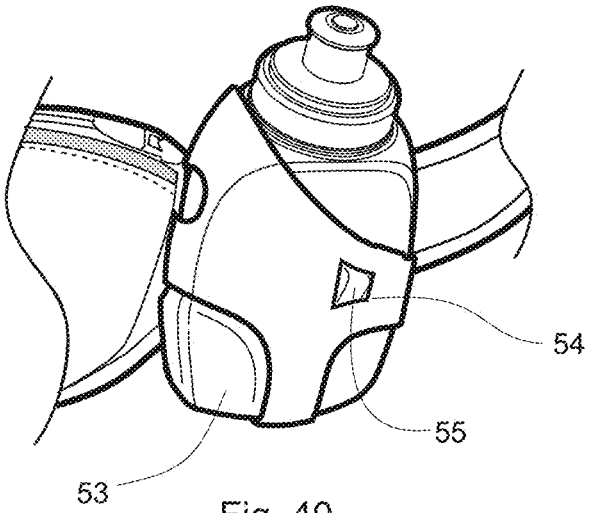
FIG. 40 is a perspective view of a sleeve that is representative of an alternate embodiment of the disclosed invention.

FIG. 40 is a perspective view another version of a sleeve wherein a hole 54 or similar feature is placed in the sleeve to mate with a local protrusion 55 or similar feature formed. The hole and protrusion are each configured to be of a size and location such that the protrusion will extend at least partially through the hole when the bottle is within the sleeve, thereby adding another layer of security to the sleeve system.

Figure 41:
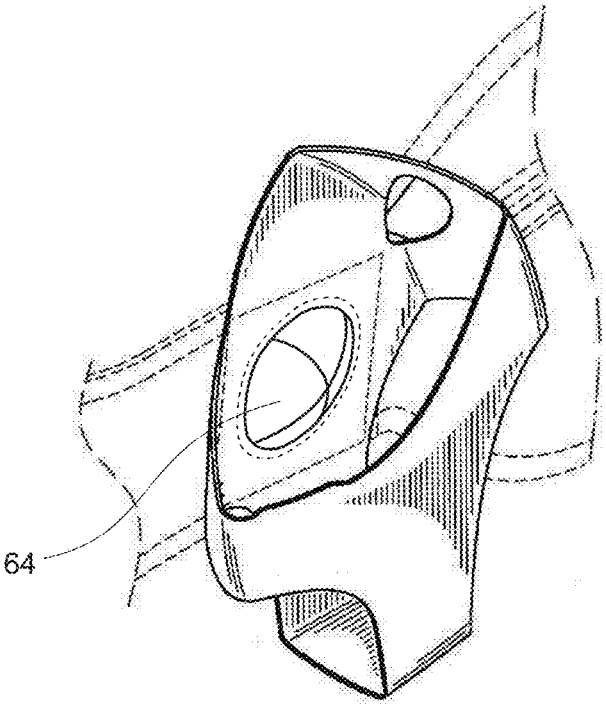
FIG. 41 is a perspective view of a sleeve that is representative of an alternate embodiment of the disclosed invention.

FIG. 41 is a perspective view of another alternate version of a sleeve. Optional bulged area 64 is shown, in which the bulged area 64 extends inwardly into the area bounded by the sleeve. This area is designed to mate with a receiving concavity formed on the bottle wherein the bulged area 64 would help hold the bottle in the sleeve along with the other desirable features.

Figure 42:
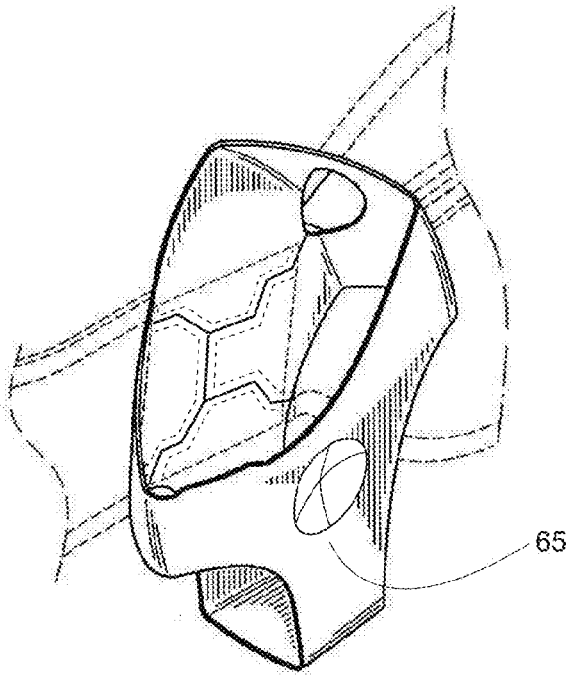
FIG. 42 is a perspective view of a sleeve that is representative of an alternate embodiment of the disclosed invention.

FIG. 42 is a perspective view of another alternate version of a sleeve. In this example, concavity 65 is formed on the outer surface of the sleeve, as an interior convex feature extending into the sleeve, designed to mate with a mating concavity on the bottle.

Figure 43:
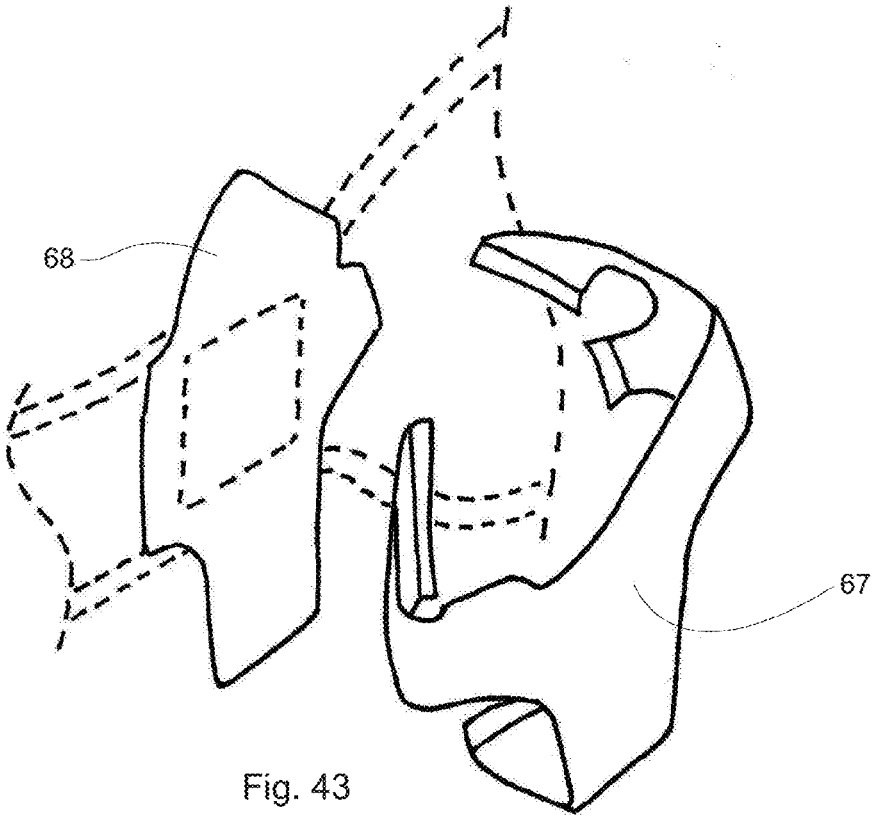
FIG. 43 is a perspective exploded view of a sleeve representative of the disclosed invention wherein an alternate sleeve assembly method is shown.

FIG. 43 is a perspective exploded view of a sleeve representative of the disclosed invention wherein an optional method of assembling the sleeve is shown wherein the sleeve is assembled from two (or more) parts as shown, wherein a belt panel 68 is sewn to the belt or the like and a sleeve portion 67 is formed and sewn, heat-bonded, glued, ultra-sonically bonded or the like to the belt panel 68 such that a sleeve appropriate to the disclosed invention is formed.

Figure 44:
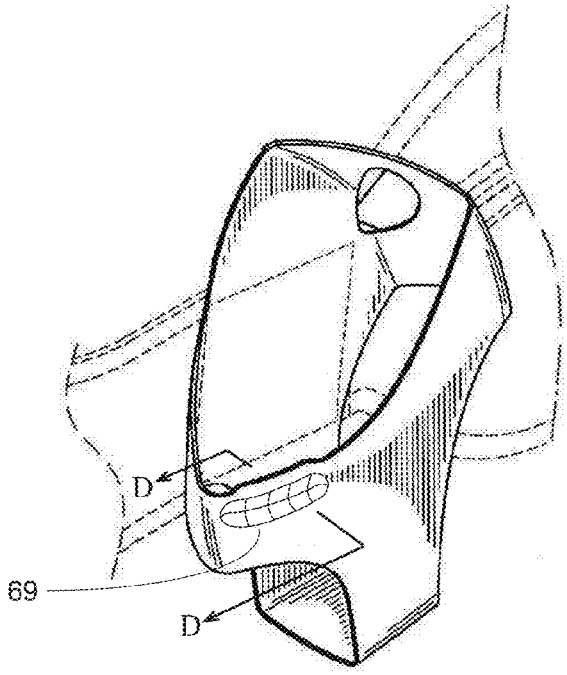
FIG. 44 is a perspective view of a sleeve that is representative of an alternate embodiment of the disclosed invention. Section cutting line D-D is shown.
Figure 45:
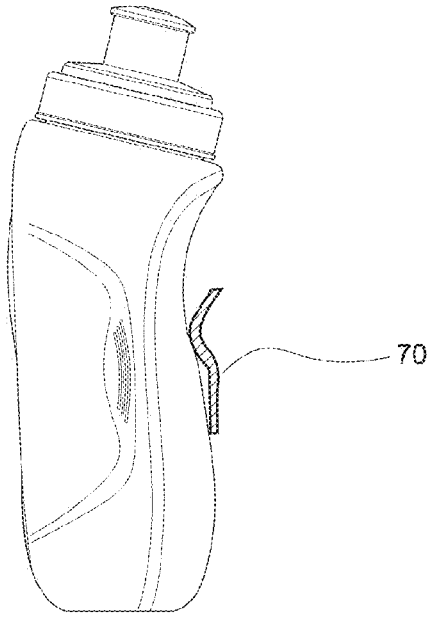
FIG. 45 is a section view cut through section D-D of FIG. 44 wherein an embodiment of preferred geometry for a preferred sleeve is shown and further wherein a preferred bottle is shown such that it can be seen how a preferred bottle can fit with a preferred embodiment of the disclosed preferred sleeve.

FIG. 44 is a perspective view of yet another version of the sleeve, in this case incorporating an indentation feature 69. Section cutting line D-D is shown such that it can be understood with reference to FIG. 45 that the indentation feature 69 is formed in the sleeve which has a cross-section 70, shown adjacent an exemplary bottle.

FIG. 46 and FIG. 47 show examples of preferred angles at which the preferred sleeve can be mounted to the preferred belt 13. It can be seen in FIG. 46 and FIG. 47 in combination with previously disclosed geometry how the preferred bottle is trapped from removal from the sleeve when a jogging force in the direction 51 is applied. FIG. 37 shows how the preferred sleeve preferably wraps around a top shoulder of the bottle. Formed surface 62 in combination with the disclosed preferred bottle detent area 63 geometry along with other disclosed sleeve and bottle geometry create a very reliable system for securely holding a bottle or the like yet while making that bottle or other item simply user-accessible when a user pulls the bottle in direction 52.

It can be seen in FIG. 46 and FIG. 47 that as the cant (or angle) at which the sleeve is mounted to the belt 13 is increased the security of the bottle can be affected wherein the jogging force angle 51 (the up-and-down natural bouncing force of running/jogging that is imparted on the bottle, the up portion of this 51 imparting a force to eject the bottle from the sleeve) becomes less close to parallel with the removal angle 52 and thus can increase the security of holding the bottle in the sleeve. Although preferably as disclosed, to remove the bottle, first a slight twist/angle as shown in FIG. 35 and FIG. 38 is accomplished by the user which allows the bottle to be removed, so this action further increases the security of the bottle and eliminates any chance for the bottle to fall out of the sleeve during use.

Although the novel disclosed invention shown that the preferred sleeve can be mounted to a belt and/or belt with a pouch/pack the preferred sleeve can be mounted to many other substrates/panels packs, bags, straps, device, etc. where ready-access to a bottle or the like is desirable.

Preferable stitch connection 32 could also be accomplished with rivets, various forms of stitching, integrally or insert molded features, this area can be heat sealed together such that a similar binding result is obtained.

Although the preferred geometry of the disclosed sleeve preferred integrates a folded-over detent flap to provide the disclosed desirable geometry and structure, for some cases it may be desirable to have this structure added or integrated into the sleeve via a molded-in or added/fastened-on feature such that this feature fits with the bottle as disclosed preferably off-center as disclosed such that the bottle is secured but also easily user-removable.

As disclosed the preferred folded-over detent flap can itself provide desired structure or a detent form structure can be integrated to add structure and form as desired. The disclosed preferred sleeve is preferably constructed by sewing a somewhat flat die-cut panel of plastic/fabric or the like together, preferably by connecting the desired sleeve to a preferred belt. Although less preferably the sleeve can be constructed by knitting, gluing, integrally forming and/or otherwise fastening parts together that have been manufactured from a variety of processes and techniques. Some other optional but less desirable (for most situations) fabrics for preferred sleeve include: neoprene, rubber, leather, felt, waterproof/water resistant fabric and/or breathable/punched fabric or the like. Sleeve parts can be constructed in a number fabrics of different materials with varying degrees of success. The invention, with varying degrees of success could be constructed in a variety of different ways other than the preferred cut and sewn or otherwise fastened together manner. For example various parts of the invention could be combined, molded as one, woven, heat sealed together, ultrasonically bonded together or formed in other ways.

The preferred fastening stitch 32 could be replaced with another type of fastener, integrally formed, woven in place or produced in a variety of other methods (although in most cases the disclosed stitch method is preferred). The preferred fastening stitch could be replaced with many different kinds of snaps, loop systems, magnets, hook/loops/Velcro and other fasteners, incorporated in other arrangements with varying degrees of success.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A bottle sleeve for a mating bottle, comprising:

an outer sleeve sidewall defining an interior space, the outer sleeve sidewall having a lower central portion including a floor;

a first open area formed at a juncture of the floor and the outer sleeve sidewall;

a second open area formed at a juncture of the floor and the outer sleeve sidewall, the second open area being positioned diametrically opposite the first open area;

the outer sleeve sidewall extending upwardly from the floor and terminating in an upper rim, the upper rim having a first side positioned above the first open area and a second side positioned above the second open area, the outer sleeve sidewall extending higher above the floor to the second side than to the first side, the second side of the rim being positioned diametrically opposite the first side, the second side of the rim further extending inward, at least partially over the interior space formed by the outer sleeve sidewall;

whereby when the bottle is removably inserted into the bottle sleeve, the second side of the rim being positioned to engage an upper shoulder on the bottle to impede removal of the bottle from the bottle sleeve; a detent positioned on an inner surface of the outer sleeve sidewall, the detent being positioned adjacent the first side of the rim, diametrically opposite the second side of the rim; wherein the bottle sleeve is formed from flat sheet material, the detent comprising a detent form trapped between opposing surfaces of a portion of the flat sheet material folded inward along the first side of the rim.

2. The bottle sleeve of claim 1, wherein the detent form is configured as a tubular member attached to the interior surface of the sleeve sidewall.

3. The bottle sleeve of claim 1, wherein the detent is tapered such that it narrows in a direction from the first side of the rim toward the second side of the rim.

4. The bottle sleeve of claim 1, wherein the flat sheet material of the bottle sleeve has a central stem defining the lower central portion and the floor, a right branch defining the first portion of the rim, a left upper branch defining the second portion of the rim, and a left lower branch.

5. The bottle sleeve of claim 4, wherein each of the central stem, the right branch, the left upper branch, and the left lower branch terminates in an end, each of the ends being joined together to form the bottle sleeve.

6. The bottle sleeve of claim 4, wherein the portion of the flat sheet material folded inward along the first side of the rim comprises a detent flap formed on the right branch, the detent flap being folded downward toward the floor when the bottle sleeve is formed.

7. The bottle sleeve of claim 1, wherein the bottle comprises a lower shelf, the lower shelf forming a surface that engages a boundary of the first open area to retain the bottle within the sleeve.

8. The bottle sleeve of claim 1, further comprising a belt configured to be worn by a user, the bottle sleeve being attached to the belt.

9. A bottle sleeve for a mating bottle, comprising:

an outer sleeve sidewall defining an interior space, the outer sleeve sidewall having a lower central portion including a floor;

the outer sleeve sidewall extending upwardly from the floor and terminating in an upper rim, the upper rim having a first side and a second side, the outer sleeve sidewall extending higher above the floor to the second side than to the first side, the second side of the rim being positioned diametrically opposite the first side, the second side of the rim further extending inward to form a shoulder, at least partially over the interior space formed by the outer sleeve sidewall; and a detent positioned on an inner surface of the sidewall and along the first side of the rim, diametrically opposite the shoulder;

whereby when the bottle is removably inserted into the bottle sleeve, the second side of the rim being positioned to engage an upper shoulder on the bottle to impede removal of the bottle from the bottle sleeve; a detent form attached to the detent, wherein the bottle sleeve is formed from flat sheet material, the detent form being trapped between opposing surfaces of a portion of the flat sheet material folded inward along the first side of the rim.

10. The bottle sleeve of claim 9, wherein the detent form is configured as a tubular member attached to the interior surface of the sleeve sidewall.

11. The bottle sleeve of claim 9, wherein the detent is tapered such that it narrows in a direction from the first side of the rim toward the second side of the rim.

12. The bottle sleeve of claim 9, wherein the flat sheet material of the bottle sleeve has a central stem defining the lower central portion, a right branch defining the first portion of the rim, a left upper branch defining the second portion of the rim, and a left lower branch.

13. The bottle sleeve of claim 12, wherein each of the central stem, the right branch, the left upper branch, and the left lower branch terminates in an end, each of the ends being joined together to form the bottle sleeve.

14. The bottle sleeve of claim 12, wherein the portion of the flat sheet material folded inward along the first side of the rim comprises a detent flap formed on the right branch, the detent flap being folded downward toward the floor when the bottle sleeve is formed.

15. The bottle sleeve of claim 9, wherein the bottle sleeve comprises a first lower open area forming an open area boundary adjacent the central portion, the bottle having a lower shelf, the lower shelf forming a surface that engages a boundary of the first open area to retain the bottle within the sleeve.

16. The bottle sleeve of claim 9, further comprising a belt configured to be worn by a user, the bottle sleeve being attached to the belt.

* * * * *